US012188685B2

(12) United States Patent
Kim et al.

(10) Patent No.: US 12,188,685 B2
(45) Date of Patent: Jan. 7, 2025

(54) HYGIENE MANAGEMENT DEVICE FOR ENTRANCE HALL

(71) Applicant: LG ELECTRONICS INC., Seoul (KR)

(72) Inventors: Taihong Kim, Seoul (KR); Hyunbyung Cha, Seoul (KR); Hyunsun Yoo, Seoul (KR); Joohyeon Oh, Seoul (KR); Byoungjoonphilip Han, Seoul (KR); Sang Yoon Lee, Seoul (KR); HyunJu Kim, Seoul (KR); Chul Bae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 506 days.

(21) Appl. No.: 17/550,627

(22) Filed: Dec. 14, 2021

(65) Prior Publication Data

US 2022/0186956 A1 Jun. 16, 2022

(30) Foreign Application Priority Data

Dec. 14, 2020 (KR) ..... 10-2020-0174512
Feb. 4, 2021 (KR) ..... 10-2021-0015903

(51) Int. Cl.

| | |
|---|---|
| ***F24F 9/00*** | (2006.01) |
| ***F24F 11/79*** | (2018.01) |
| ***F24F 13/072*** | (2006.01) |
| ***F24F 120/12*** | (2018.01) |

(52) U.S. Cl.

CPC ..... *F24F 9/00* (2013.01); *F24F 11/79* (2018.01); *F24F 13/072* (2013.01); *F24F 2009/007* (2013.01); *F24F 2120/12* (2018.01)

(58) Field of Classification Search

CPC .. F24F 9/00; F24F 11/79; F24F 13/072; F24F 2120/12; F24F 2009/007; F24F 3/167; F24F 13/06; F24F 13/065; B08B 5/02; B08B 15/02; B05B 1/005; E06B 3/90

See application file for complete search history.

(56) References Cited

U.S. PATENT DOCUMENTS

2012/0090239 A1* 4/2012 Hondius ..... E06B 3/90 49/27

FOREIGN PATENT DOCUMENTS

| | | | |
|---|---|---|---|
| CN | 1146002 A | * | 3/1997 |
| CN | 203648916 U | * | 6/2014 |
| CN | 204503669 U | * | 7/2015 |
| DE | 198 08 910 A1 | | 8/1999 |
| JP | 2009121716 A | * | 6/2009 |

(Continued)

OTHER PUBLICATIONS

English translation of CN-203648916-U, dated May 31, 2024 (Year: 2024).*

(Continued)

*Primary Examiner* — Edelmira Bosques
*Assistant Examiner* — Brett Peterson Mallon
(74) *Attorney, Agent, or Firm* — Birch, Stewart, Kolasch & Birch, LLP

(57) ABSTRACT

A hygiene management device for an entrance hall includes a fan assembly, a duct and an air discharger that discharges air toward a person at positions around the person in consideration of a person's height or such that an air discharge angle is adjusted upward/downward in consideration of a person's face position or a person's height.

20 Claims, 30 Drawing Sheets

(56) References Cited

FOREIGN PATENT DOCUMENTS

| | | | | |
|---|---|---|---|---|
| JP | 2012-7881 | A | | 1/2012 |
| KR | 1997-0016365 | A | | 4/1997 |
| KR | 10-2009-0040630 | A | | 4/2009 |
| KR | 10-1382061 | B1 | | 4/2014 |
| KR | 10-2019-0055303 | A | | 5/2019 |
| KR | 10-2020-0046715 | A | | 5/2020 |
| KR | 10-2020-0117286 | A | | 10/2020 |
| KR | 20200112031 | A | * | 10/2020 |
| TW | M506260 | U | | 8/2015 |

OTHER PUBLICATIONS

English translation of CN-204503669-U, dated May 31, 2024 (Year: 2024).*
English translation of KR20200112031A, dated May 31, 2024 (Year: 2024).*
English translation of CN-1146002-A, dated May 31, 2024 (Year: 2024).*
English translation of JP-2009121716-A, dated May 31, 2024 (Year: 2024).*

* cited by examiner

HYGIENE MANAGEMENT DEVICE FOR ENTRANCE HALL

CROSS REFERENCE TO RELATED APPLICATIONS

This application claims the priority benefit of Korean Patent Application No. 10-2020-0174512, filed on Dec. 14, 2020 in the Republic of Korea and Korean Patent Application No. 10-2021-0015903, filed on Feb. 4, 2021 in the Republic of Korea, which are hereby incorporated by reference in their entirety for all purposes as if fully set forth herein.

BACKGROUND OF THE INVENTION

1. Field of the Invention

The present disclosure relates to a device provided to manage the hygiene of a person who goes in and out of an entrance hall.

2. Description of the Background Art

Generally, an entrance hall is located between the outside and a specific indoor space to be connected to each other by the entrance hall. That is, a person is required to go through the entrance hall to enter the indoor space from the outside or to go out to the outside from the indoor space.

A vestibule is provided at the inner side of such an entrance hall, and the preparation or maintenance of the vestibule is performed for a person going out of or in the vestibule.

Meanwhile, to prevent outdoor contaminants from being introduced into the indoor space, the contaminants of a person are preferably removed from outside of the vestibule or from within the vestibule.

Accordingly, there is an air curtain which prevents contaminants from being introduced into the indoor space. However, the air curtain just blocks external air, but during the entering/exiting of a person, the external air may also be introduced into the vestibule (i.e., may still be introduced into the vestibule).

To solve such a problem, there are various technologies disclosed in Korean Patent Application Publication No. 10-2009-0040630 (Patent Document 1), Korean Patent Application Publication No. 10-2020-0117286 (Patent Document 2), Korean Patent Application Publication No. 10-2020-0046715 (Patent Document 3), and Korean Patent Application Publication No. 10-2019-0055303 (Patent Document 4).

That is, in the technology disclosed in Patent Document 1, air is showered on a person to remove contaminants, such as dust, from the clothing of a person.

Furthermore, in the technology disclosed in Patent Document 2, in addition to the air shower, a photocatalytic lamp is installed on a ceiling to simultaneously remove contaminants, such as dust, and harmful substances, such as viruses, from the clothing of a person.

Furthermore, in the technology disclosed in Patent Document 3, a lighting fixture and an air cleaning system are integrated with each other such that contaminants are removed from a person in an entrance space, such as a vestibule.

Furthermore, in the technology disclosed in Patent Document 4, a shower booth having a predetermined shower space thereinside is separately installed such that a person can remove contaminants in the shower booth.

Particularly, in each of the related technologies, in the circulation process of air discharged for air showering, after foreign matter contained in the associated air is removed, the air is re-discharged.

However, in the technologies disclosed in Patent Document 1, Patent Document 2, and Patent Document 3, air is discharged intensively to a person's head. Because of this, it is difficult to remove contaminants such as dust attached to the clothing (particularly, pants) of a person.

Of course, in Patent Document 2, disclosed is the technology in which a discharge nozzle is positioned in a shoe closet located at one side of a vestibule so as to discharge air to a person.

However, in the technology disclosed in Patent Document 2, air is discharged only to any one side portion of a person. That is, air is not discharged to other portions of a person (for example, the front, rear, or other side surfaces of the person), so the removal efficiency of contaminants is decreased.

Furthermore, in each of the technologies described above, regardless of a person's height, air is constantly discharged at a constant air volume or in the same direction. Because of this, for a relatively short person, the effect of air discharged from the upper side of the person is relatively small, so the removal efficiency of contaminants attached to the person is decreased.

Particularly, in the case of the technology disclosed in Patent Document 2, air may be discharged toward a person's face, and accordingly, during the air discharge, the person may have difficulty in breathing or may feel unpleasant due to the air discharge to the person's respiratory organs.

DOCUMENTS OF RELATED ART (Patent Document 1) Korean Patent Application Publication No. 10-2009-0040630

(Patent Document 2) Korean Patent Application Publication No. 10-2020-0117286

(Patent Document 3) Korean Patent Application Publication No. 10-2020-0046715

(Patent Document 4) Korean Patent Application Publication No. 10-2019-0055303

SUMMARY OF THE INVENTION

The present disclosure has been made keeping in mind the above problems occurring in the related arts described above.

The present disclosure is intended to propose a hygiene management device for an entrance hall in which at a plurality of positions around a person, air is discharged toward the person, such that contaminants (i.e., dust or other contaminants) on the person's clothing are efficiently removed.

In addition, the present disclosure is intended to propose a hygiene management device for an entrance hall in which air is discharged in consideration of the height of a person, such that a sufficient amount of air is discharged toward the person regardless of a person's height.

Furthermore, the present disclosure is intended to propose a hygiene management device for an entrance hall in which air is discharged in consideration of a person's face position, such that the person is prevented from having inconvenient breath or feeling unpleasant due to the air discharge.

In order to achieve the above objectives, a hygiene management device for an entrance hall of the present disclosure may include an air discharger configured to discharge air from a pillar frame toward a person. That is, instead of discharging air to a person's head, the air is discharged to the front or back of the person, or to opposite sides or diagonal directions of the person.

In addition, in the hygiene management device for an entrance hall of the present disclosure of the present disclosure, the air discharger may include a top plate located above a person, and a footrest located on the bottom of an entrance space (i.e., below the person such that the person stands on the footrest) and facing the top plate.

Furthermore, in the hygiene management device for an entrance hall of the present disclosure, the pillar frame may be installed to connect the top plate with the footrest. Accordingly, the top plate, the footrest, and the pillar frame may form an assembly.

Additionally, in the hygiene management device for an entrance hall of the present disclosure, a discharge nozzle part may be formed in the pillar frame, such that air can be discharged to a person through the discharge nozzle part. Accordingly, it is possible to discharge air to a desired portion.

In addition, in the hygiene management device for an entrance hall of the present disclosure, the pillar frame may include a plurality of pillar frames. Accordingly, foreign matter attached to the front, back, and opposite sides of a person may be efficiently removed.

Furthermore, in the hygiene management device for an entrance hall of the present disclosure, the plurality of pillar frames may be installed respectively on at least two corners of the top plate or the footrest. Accordingly, it is possible to discharge air over the entire body of a person.

Additionally, in the hygiene management device for an entrance hall of the present disclosure, the pillar frame may be installed rotatably toward opposite sides. That is, air may be discharged toward a person even if the person passes through the entrance space while continuing to move without stopping in the entrance space.

In addition, in the hygiene management device for an entrance hall of the present disclosure, a pillar rotating part may be provided to rotate the pillar frame. That is, the pillar frame may rotate automatically.

Furthermore, in the hygiene management device for an entrance hall of the present disclosure, the pillar rotating part may be provided on the upper surface of the top plate. That is, the pillar rotating part may not be exposed to the outside.

Additionally, in the hygiene management device for an entrance hall of the present disclosure, the pillar rotating part may include a rotary motor and may be configured to adjust the rotation angle of the pillar frame. That is, the rotation angle of the pillar frame may be adjusted according to a person's position (e.g., the direction in which the person faces).

In addition, in the hygiene management device for an entrance hall of the present disclosure, an upper roller may be provided on the upper surface of the pillar frame, and an upper guide groove in which the upper roller is received to move may be formed in the top plate. That is, the pillar frame may be rotated according to a precise position.

Furthermore, in the hygiene management device for an entrance hall of the present disclosure, a lower roller may be provided on the lower surface of the pillar frame, and a lower guide groove in which the lower roller is received to move may be formed in the footrest. That is, the pillar frame may be rotated according to a precise position.

Additionally, in the hygiene management device for an entrance hall of the present disclosure, the discharge nozzle part may include a plurality of discharge nozzle parts and the discharge nozzle parts may be located at the pillar frame to be spaced vertically apart from each other. That is, air may be discharged to as many portions of a person as possible.

In addition, in the hygiene management device for an entrance hall of the present disclosure, each of the discharge nozzle parts may be configured to selectively supply air. That is, the discharge nozzle parts may be controlled such that only one of the discharge nozzle parts discharges air or all the discharge nozzle parts discharge air.

Furthermore, in the hygiene management device for an entrance hall of the present disclosure, the pillar frame may include a detector. That is, the detector may detect a person's height or face position.

Additionally, in the hygiene management device for an entrance hall of the present disclosure, the detector may be located in the discharge nozzle part.

In addition, in the hygiene management device for an entrance hall of the present disclosure, the discharge nozzle part may be installed to perform upward/downward inclination adjustment. That is, the upward/downward discharge direction of air may be adjusted.

Furthermore, in the hygiene management device for an entrance hall of the present disclosure, the upward/downward slanting of the discharge nozzle part may be adjusted by a nozzle angle adjustment part. That is, the upward/downward inclination of the discharge nozzle part may be automatically adjusted.

Additionally, in the hygiene management device for an entrance hall of the present disclosure, an angle adjustment part may include an angle adjustment motor. That is, the fine upward/downward inclination adjustment of the discharge nozzle part may be performed.

In addition, in the hygiene management device for an entrance hall of the present disclosure, the discharge nozzle part may be connected to a guide tube. That is, the discharge nozzle part may receive air flowing through the guide tube and may discharge the air to a person.

Furthermore, in the hygiene management device for an entrance hall of the present disclosure, a flow path opening/closing valve may be provided in the connection part of the guide tube with an air transfer duct. That is, only some of the discharge nozzle parts or all of the discharge nozzle parts may selectively discharge air due to the flow path opening/closing valve.

Additionally, in the hygiene management device for an entrance hall of the present disclosure, a duct unit (i.e., duct) and the pillar frame may be configured to be connected to each other by the guide tube to transfer air therebetween.

In addition, in the hygiene management device for an entrance hall of the present disclosure, the guide tube may be configured as a bendable hose. That is, even if the discharge nozzle part to which the guide tube is connected slants in an upward/downward direction, a connection part therebetween may be prevented from being disconnected.

Furthermore, in the hygiene management device for an entrance hall of the present disclosure, an air management module may be provided at the air inlet of a fan assembly. That is, before air is introduced into the fan assembly, foreign matter or contaminants contained in the air may be removed.

Additionally, in the hygiene management device for an entrance hall of the present disclosure, introduction flow paths may be formed in the footrest. That is, air may, together with fine foreign matter flowing down to the footrest, flow through the introduction flow paths to the air management module such that the fine foreign matter is collected.

The hygiene management device for an entrance hall of the present disclosure described above may have at least one of the following effects.

In the hygiene management device for an entrance hall of the present disclosure, air may be discharged to a person through the pillar frame located at the perimeter of the entrance space. Accordingly, contaminants such as dust attached to the clothes of a person may be efficiently removed.

Furthermore, in the hygiene management device for an entrance hall of the present disclosure, the pillar frame may include a plurality of pillar frames, thereby discharging a sufficient amount of air to an entire area around a person. Accordingly, the effect of removing contaminants attached to a person may be improved.

Furthermore, in the hygiene management device for an entrance hall of the present disclosure, a plurality of pillar frames may be installed respectively on the corners of the top plate or the footrest, thereby discharging air to all positions around a person. Accordingly, the effect of removing contaminants attached to a person may be improved.

Furthermore, in the hygiene management device for an entrance hall of the present disclosure, the pillar frame may be installed to rotate toward opposite sides, thereby discharging air to a person regardless of a position at which the person stands.

Furthermore, in the hygiene management device for an entrance hall of the present disclosure, the pillar frame may be installed to rotate toward opposite sides, thereby discharging air toward a person while the person is moving without stopping.

Furthermore, in the hygiene management device for an entrance hall of the present disclosure, the discharge nozzle part may include a plurality of discharge nozzle parts and the discharge nozzle parts may be located on the pillar frame to be spaced vertically apart from each other, so the discharge nozzle parts may discharge air to the entire portion of a person regardless of a person's height. Accordingly, the effect of removing contaminants attached to a person may be improved.

Furthermore, in the hygiene management device for an entrance hall of the present disclosure, each of the discharge nozzle parts may be configured to selectively discharge air, so air may be prevented from being discharged to a position higher than a person's height. Accordingly, unnecessary air discharge may be prevented. Furthermore, air may be discharged intensively to a person, thereby improving the performance of removing foreign matter attached to the person's clothes.

Furthermore, in the hygiene management device for an entrance hall of the present disclosure, the detector which detects a person's height or face position may be provided, so air may be discharged only to a desired position of the person. That is, due to selective air discharge according to a person's height, unnecessary air discharge may be prevented, and air may be controlled not to be discharged to a person's face or respiratory organs.

Furthermore, in the hygiene management device for an entrance hall of the present disclosure, the discharge nozzle part may be installed to perform the upward/downward inclination adjustment, so air may be discharged in consideration of a person's face position. Accordingly, the person is prevented from having inconvenient breath or feeling unpleasant due to the air discharge.

Furthermore, in the hygiene management device for an entrance hall of the present disclosure, the flow path opening/closing valve may be provided, so only some of the discharge nozzle parts may discharge air. Accordingly, air may not be discharged to a side at which a person is not located, so unnecessary air discharge may be prevented.

Furthermore, in the hygiene management device for an entrance hall of the present disclosure, the introduction flow paths may be formed in the footrest, and thus foreign matter falling from a person passing the footrest may be transferred through the introduction flow paths to the air management module, thereby removing the foreign matter in the air management module.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
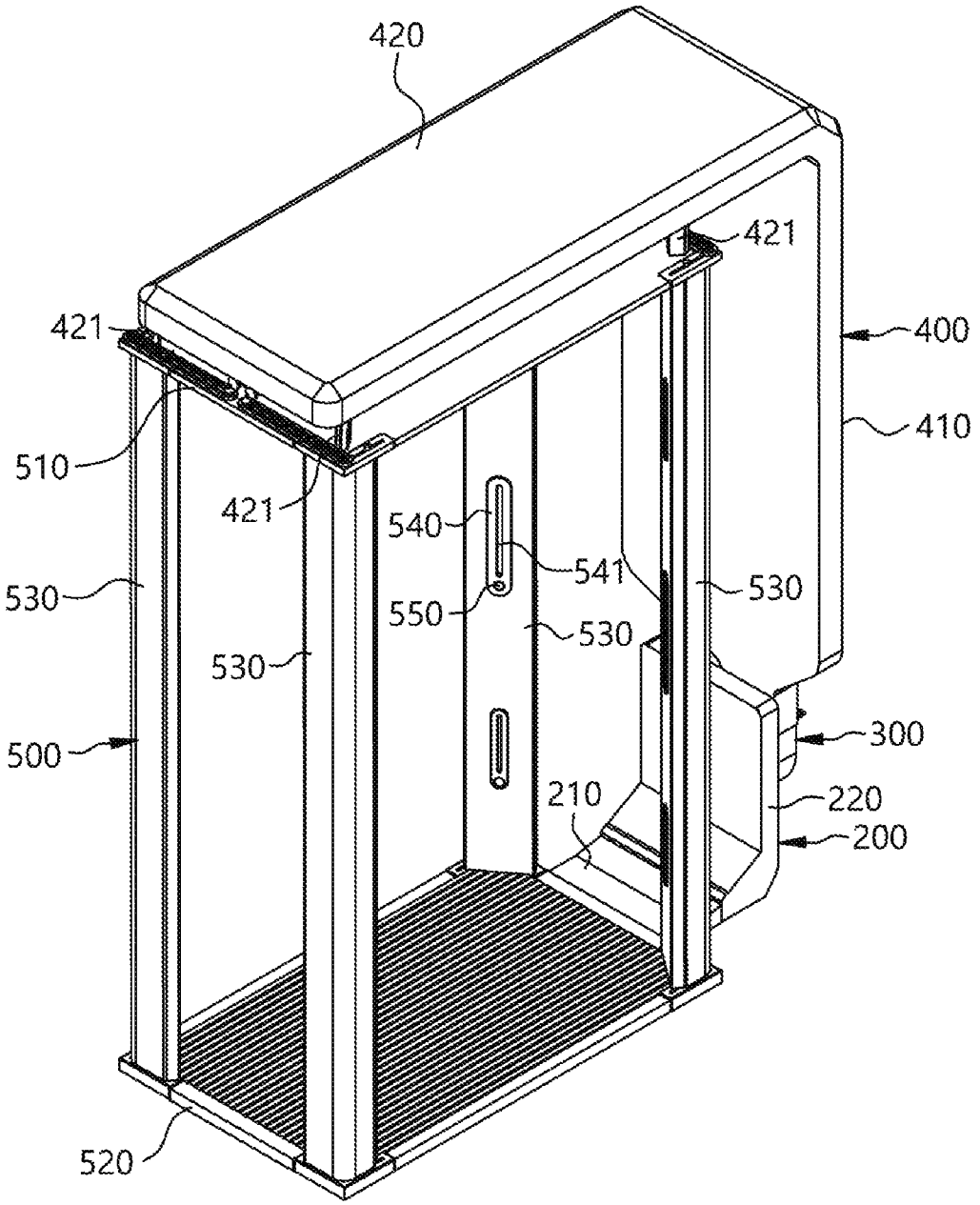
FIG. 1 is a front perspective view illustrating a hygiene management device for an entrance hall according to an embodiment of the present invention.

The present invention will now be described with reference to the accompanying drawings, wherein the same reference numerals have been used to identify the same or similar elements throughout the several views.

Hereinafter, the exemplary embodiment of a hygiene management device for an entrance hall of the present disclosure will be described with reference to FIGS. 1 to 30.

Prior to description, the hygiene management device for an entrance hall according to the embodiment of the present disclosure may be installed in an entrance space through which a person goes into and out of an indoor space.

For example, when the hygiene management device of the present disclosure is installed for a residential space, the hygiene management device may be installed in a vestibule. That is, the vestibule may be the entrance space.

When the hygiene management device for an entrance hall is used for an office space, the hygiene management device may be installed in space provided in the entrance hall of the associated office space.

Figure 2:
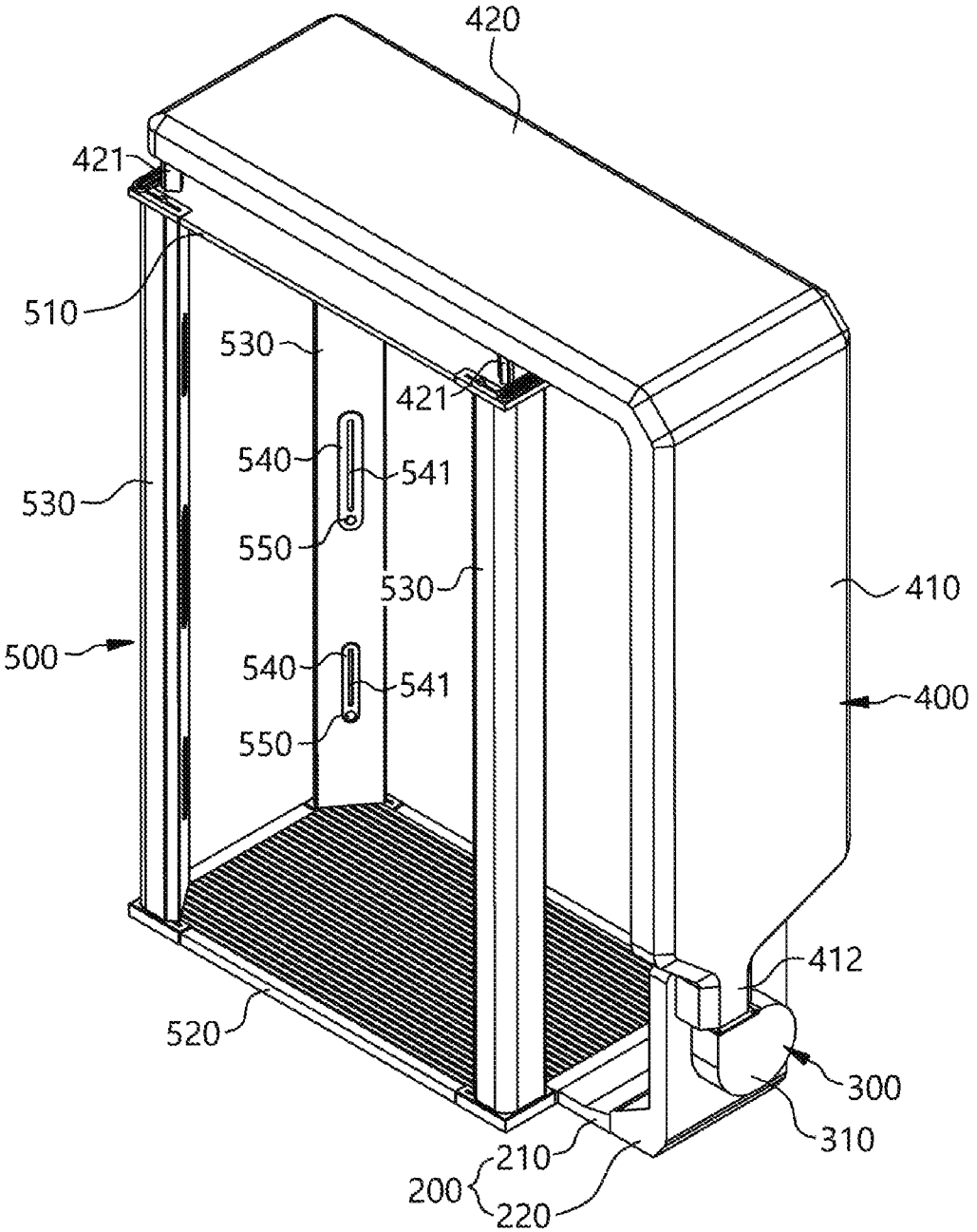
FIG. 2 is a rear perspective view illustrating the hygiene management device for an entrance hall according to the embodiment of the present invention.
Figure 3:
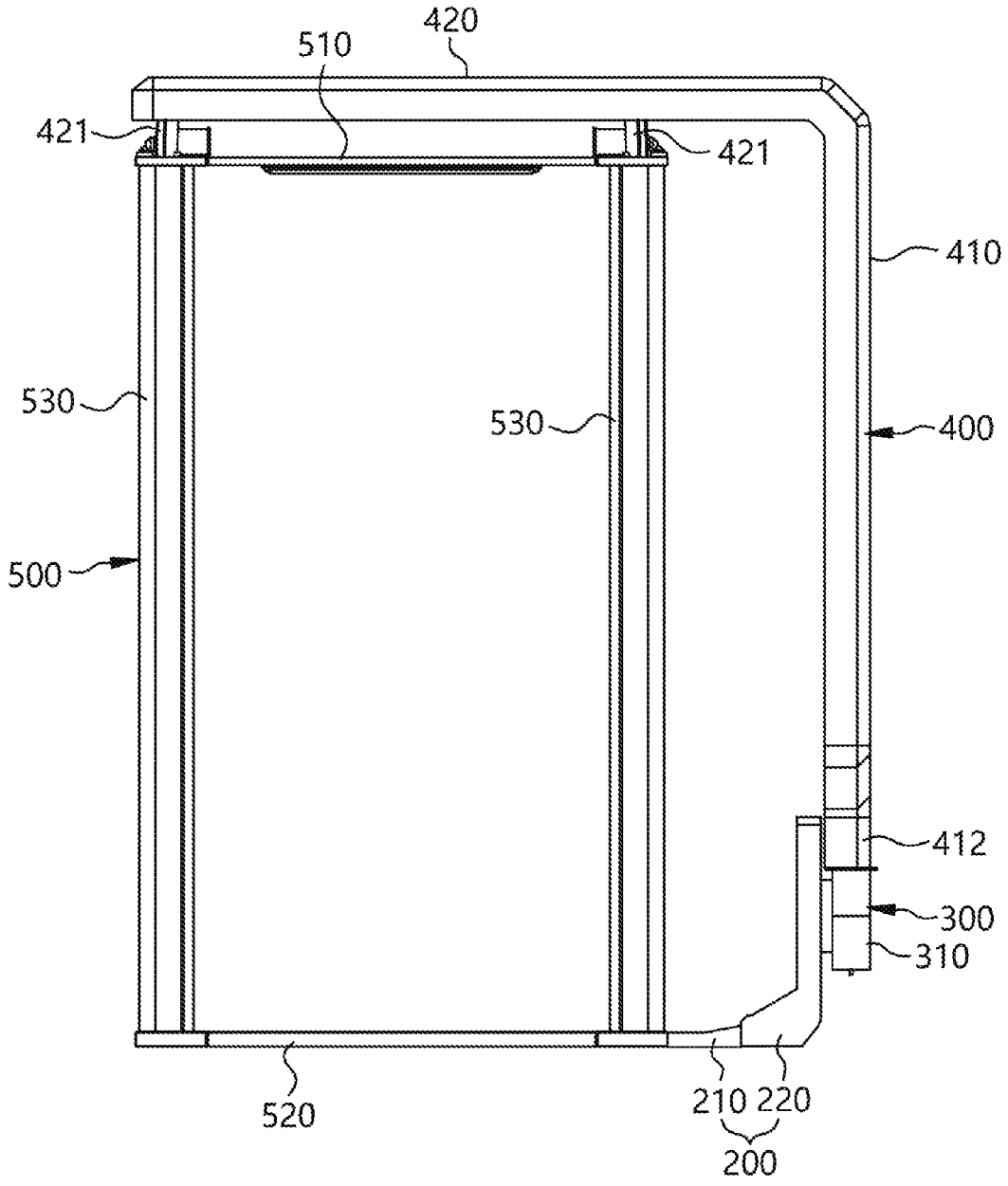
FIG. 3 is a side view illustrating the hygiene management device for an entrance hall according to the embodiment of the present invention.

FIGS. 1 and 2 are front and rear perspective views respectively illustrating the hygiene management device for an entrance hall according to the embodiment of the present invention, and FIG. 3 is a side view illustrating the hygiene management device for an entrance hall according to the embodiment of the present invention.

Figure 4:
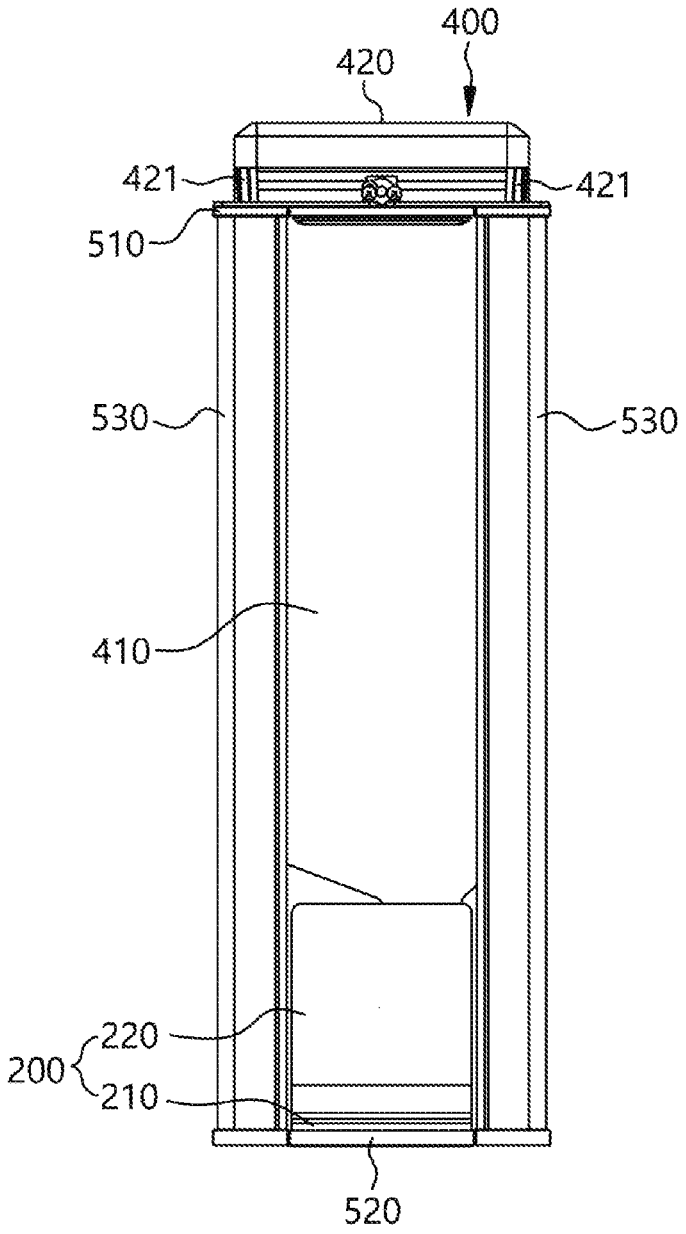
FIG. 4 is a front view illustrating the hygiene management device for an entrance hall according to the embodiment of the present invention.
Figure 5:
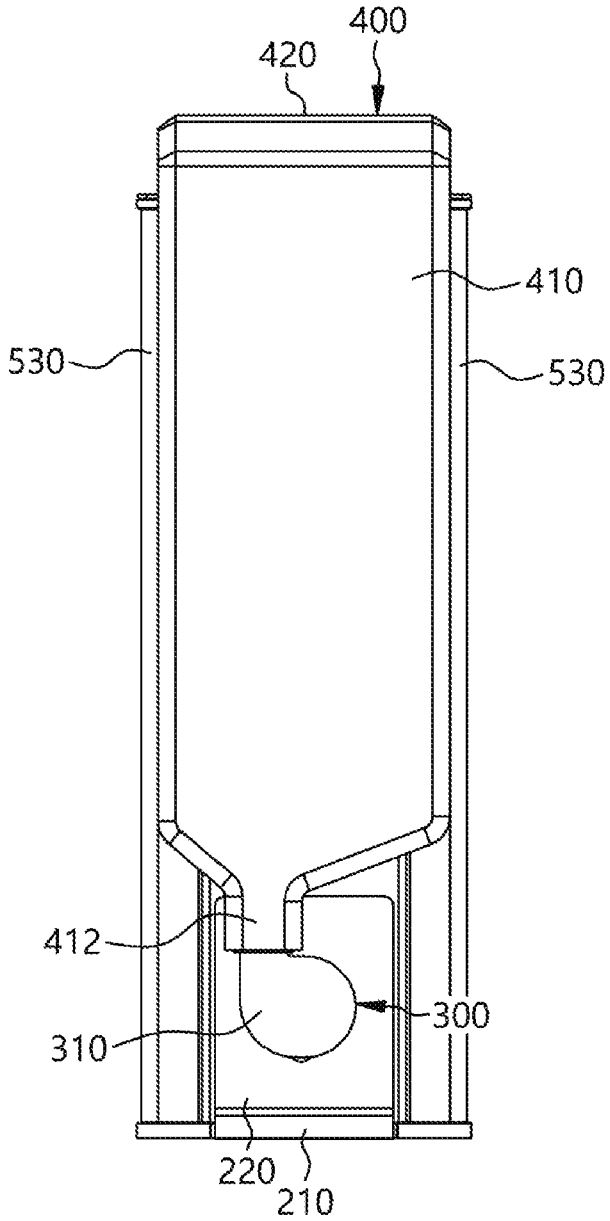
FIG. 5 is a rear view illustrating the hygiene management device for an entrance hall according to the embodiment of the present invention.
Figure 6:
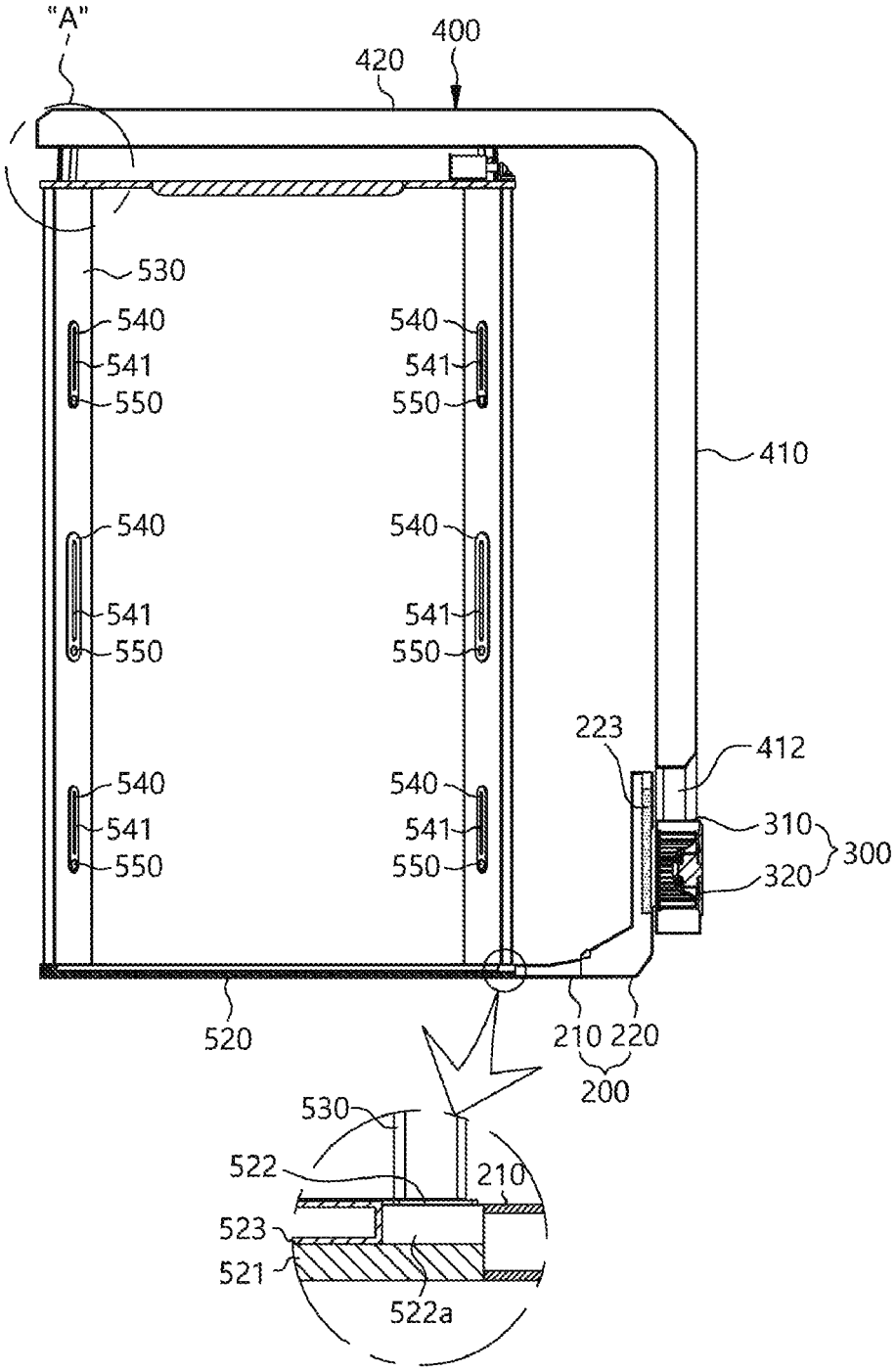
FIG. 6 is a sectional view illustrating the hygiene management device for an entrance hall according to the embodiment of the present invention.
Figure 7:
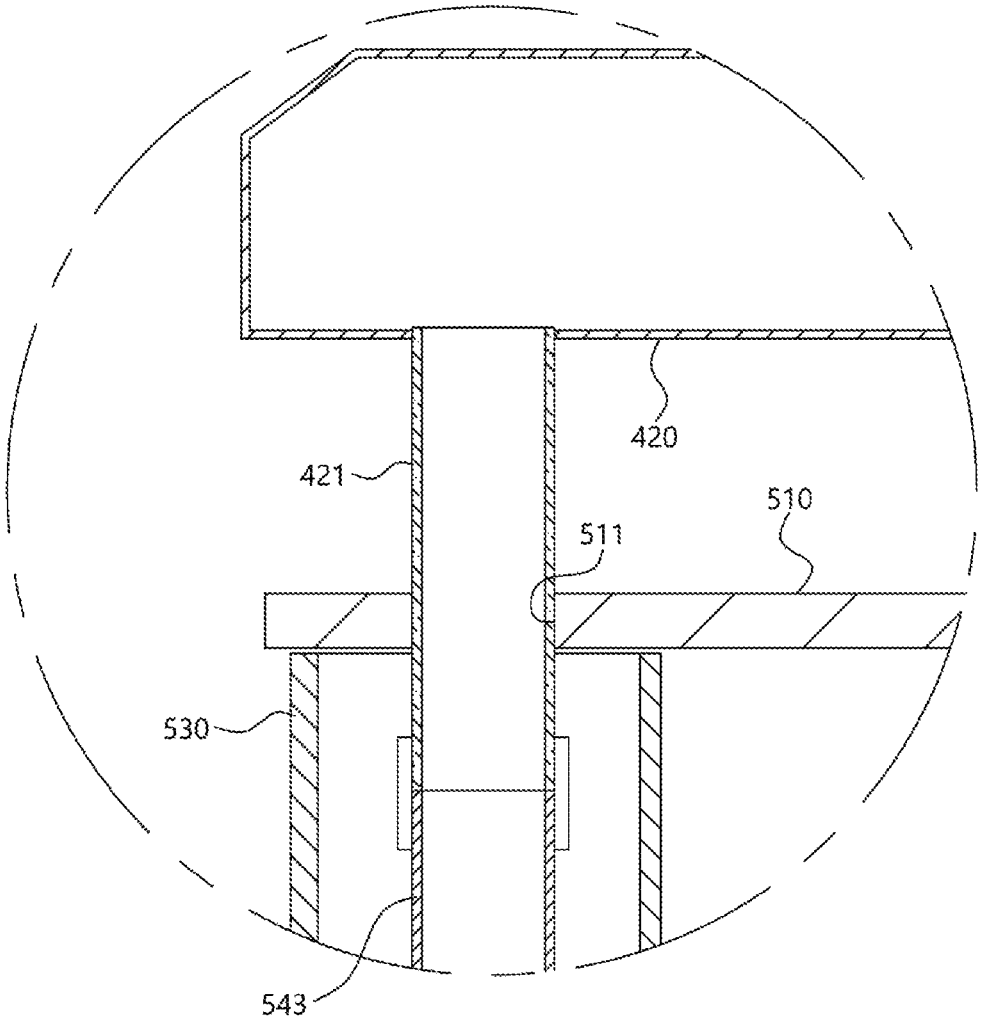
FIG. 7 is an enlarged view of the "A" part of FIG. 6.

Furthermore, FIG. 4 is a front view illustrating the hygiene management device for an entrance hall according to the embodiment of the present invention, FIG. 5 is a rear view illustrating the hygiene management device for an entrance hall according to the embodiment of the present invention, and FIG. 6 is a sectional view illustrating the hygiene management device for an entrance hall according to the embodiment of the present invention.

As illustrated in these drawings, the hygiene management device for an entrance hall according to the embodiment of the present invention may include an air discharger 500. Particularly, the air discharger 500 may be configured to discharge air from positions around a person toward the person.

In addition, the air discharger 500 may partially discharge air in consideration of a person's height. Accordingly, unnecessary air discharge may be prevented.

In addition, the air discharger 500 may be configured to adjust an air discharge angle upward/downward in consideration of a person's face position. Accordingly, complaint caused by air discharged to a person's face may be prevented.

Hereinafter, each component of the hygiene management device for an entrance hall having such characteristics according to the embodiment of the present disclosure will be described more in detail.

First, the hygiene management device for an entrance hall according to the embodiment of the present disclosure may include a fan assembly 300.

The fan assembly 300 is a device which generates an air blowing force, as known in the art.

As illustrated in FIG. 6, such a fan assembly 300 may include a fan housing 310 and a blower fan 320.

The fan housing 310 may constitute the exterior of the fan assembly 300, and the blower fan 320 may be installed inside the fan housing 310.

An inlet through which air is introduced may be formed in the side wall of the fan housing 310, and an outlet through which air is discharged may be formed in the circumferential surface of the fan housing 310. In addition, the blower fan 320 may be configured as a centrifugal fan which introduces air into the fan housing 310 in an axial direction thereof and then discharges the air in a radial direction thereof. That is, the blower fan 320 may be configured to introduce air through the side wall of the fan housing 310 and then to discharge the air to the circumference thereof. However, the blow fan 320 may be any type of fan. The blower fan 320 may be operated by a fan motor installed inside or outside of the fan housing 310.

Next, the hygiene management device for an entrance hall according to the embodiment of the present disclosure may include a duct unit 400.

The duct unit 400 serves to guide an air flow formed in the fan assembly 300 to the upper portion of the entrance space.

The duct unit 400 may include a first duct 410 and a second duct 420.

Here, the first duct 410 may extend along the side wall of the entrance space, and a first inlet 412 of the first duct 410 may be connected to the circumferential surface (the outlet) of the fan housing 310.

The first inlet 412 of the first duct 410 may be formed in the lower end of the first duct 410 and may be connected to the circumferential surface of the fan housing 310.

In this case, as illustrated in FIGS. 2 and 5, the connection part of the first inlet 412 of the first duct 410 with the fan housing 310 may be narrower than other parts of the first inlet 412, or the first inlet 412 may be configured to become narrower gradually toward the connection part of the first inlet 412 with the fan housing 310.

In addition, the second duct 420 may be located at the ceiling of the entrance space (or near the ceiling of the entrance space) and may be configured to receive air flowing through the first duct 410 (i.e., by being directly connected to the first duct 410). To this end, the first end of the second duct 420 may be connected to the first duct 410.

Furthermore, the second duct 420 may be located at the upper side of a person (i.e., above a person).

Next, the hygiene management device for an entrance hall according to the embodiment of the present disclosure may include an air management module 200.

The air management module 200 may remove foreign matter and moisture in the air flowing to the duct unit 400 (i.e., the air management module 200 may remove contaminants and other foreign matter and moisture in the air prior to the air flowing into the duct unit 400).

Such an air management module 200 may include a filter housing 220.

At least one filter 223 may be installed in the filter housing 220, and any type of filter may be used, such as a HEPA filter, a pleated filter and the like.

In addition, the air management module 200 may include a fixed connection duct 210. In this case, the fixed connection duct 210 is a duct that guides the flow of air into the filter housing 220.

The fixed connection duct 210 may be formed to extend from the filter housing 220. Specifically, the fixed connection duct 210 may be formed to extend from the lower end of the filter housing 220.

The fixed connection duct 210 may be connected to a footrest 520 to be described later and may guide air introduced through the footrest 520 to the filter housing 220.

Additionally, the air management module 200 may be configured to manage the humidity and temperature of air to be supplied to the duct unit 400. To this end, a heat exchanger may be provided on the rear end of the fixed connection duct 210. That is, air passing through the filter(s) 223 may flow through the heat exchanger to the fan assembly 300. Of course, a heater may be used instead of the heat exchanger.

In addition, the air outlet of the filter housing 220 may communicate with the air inlet of the fan housing 310 constituting the fan assembly 300. That is, while air passes through the filter housing 220, the foreign matter of the air may be removed and then the air may pass through the fan housing 310.

Next, the hygiene management device for an entrance hall according to the embodiment of the present disclosure may include the air discharger 500.

The air discharger 500 is a device configured to receive air from the second duct 420 and discharge the air toward a person.

Figure 8:
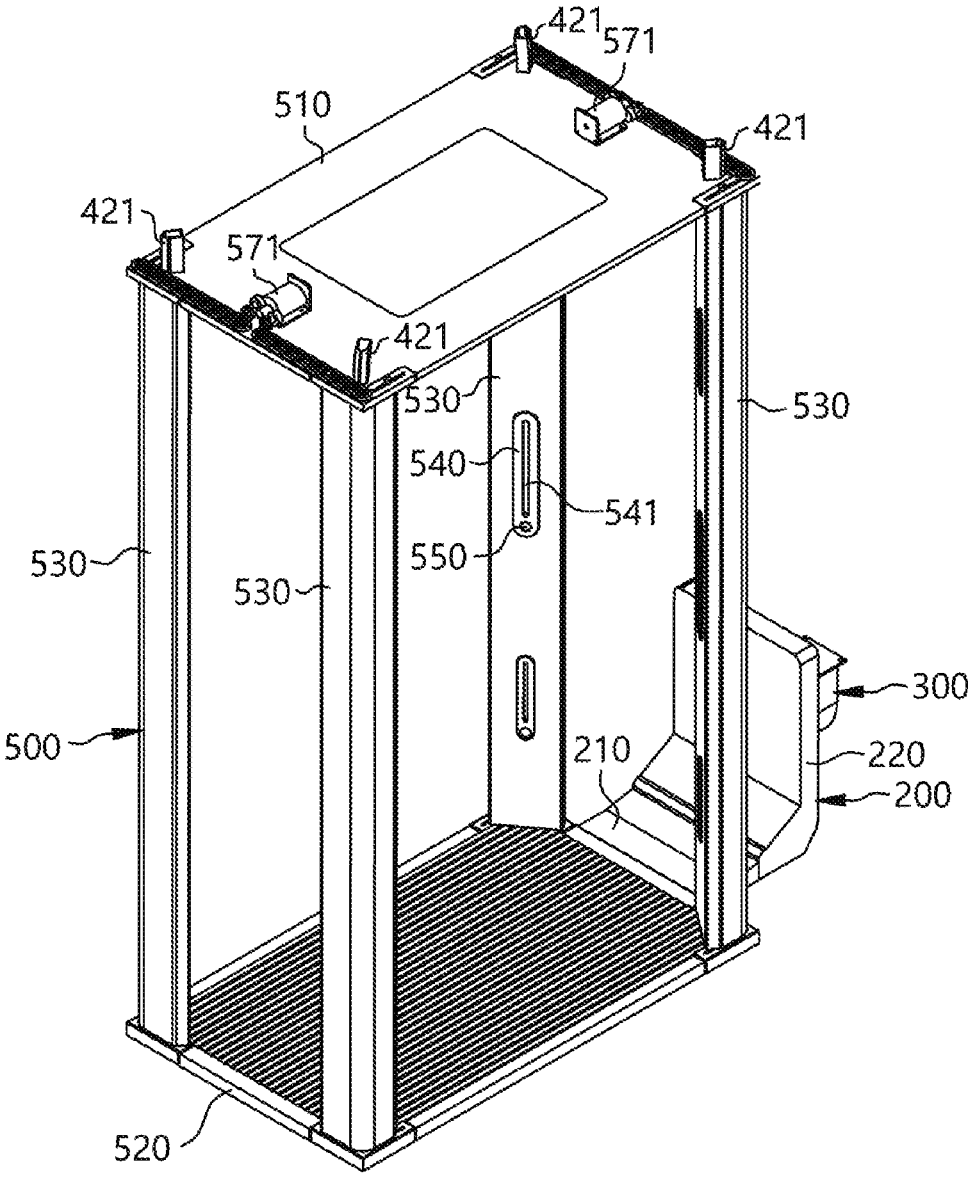
FIG. 8 is a front perspective view of the hygiene management device for an entrance hall from which a duct unit is omitted according to the embodiment of the present invention.

FIG. 6 is a sectional view illustrating the hygiene management device for an entrance hall according to the embodiment of the present invention, and FIG. 8 is a front perspective view of the hygiene management device for an entrance hall according to the embodiment of the present invention from which the duct unit is omitted.

As illustrated in these drawings, the air discharger 500 may include a top plate 510, the footrest 520, and a pillar frame 530.

The top plate 510 constituting the air discharger 500 may be located at the upper side of a person and may be provided as the ceiling part of the air discharger 500.

The top plate 510 may be configured integrally with the second duct 420 constituting the duct unit 400, or may be provided separately from the second duct 420 and configured to be fixed to the second duct 420 (i.e., directly fixed to the second duct 420).

In addition, the top plate 510 may be installed to be embedded in the ceiling of the entrance space.

In the embodiment of the present disclosure, the top plate 510 is configured to be located under the second duct 420 and support the second duct 420, as shown in FIG. 6. That is, the second duct 420 of the duct unit 400 may be configured to be supported by the top plate 510.

In addition, the top plate 510 may be configured to have a flat plate structure and may be formed in a rectangular, circular, or polygonal shape when viewed from the lower side thereof. In the embodiment of the present disclosure, the top plate 510 is configured as a flat plate having a rectangular shape, as an example.

Furthermore, the footrest 520 constituting the air discharger 500 is a part on which a person climbs from the bottom of the entrance space.

Such a footrest 520 may be located to face the top plate 510. The footrest 520 may be configured to have an area for a person to climb. In this case, the footrest 520 may be embedded in the bottom of the entrance space or mounted on the bottom of the entrance space.

Figure 9:
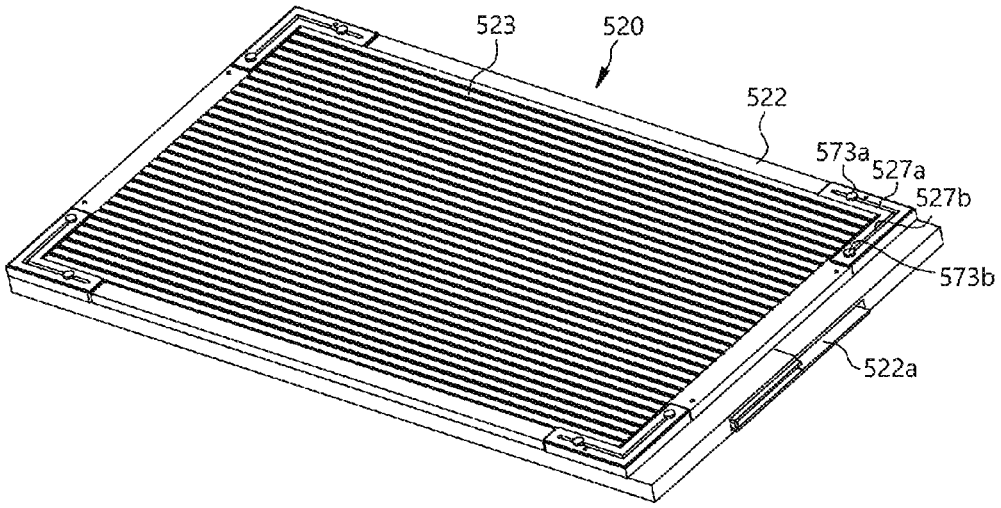
FIG. 9 is a perspective view illustrating a footrest of the hygiene management device for an entrance hall according to the embodiment of the present invention.
Figure 10:
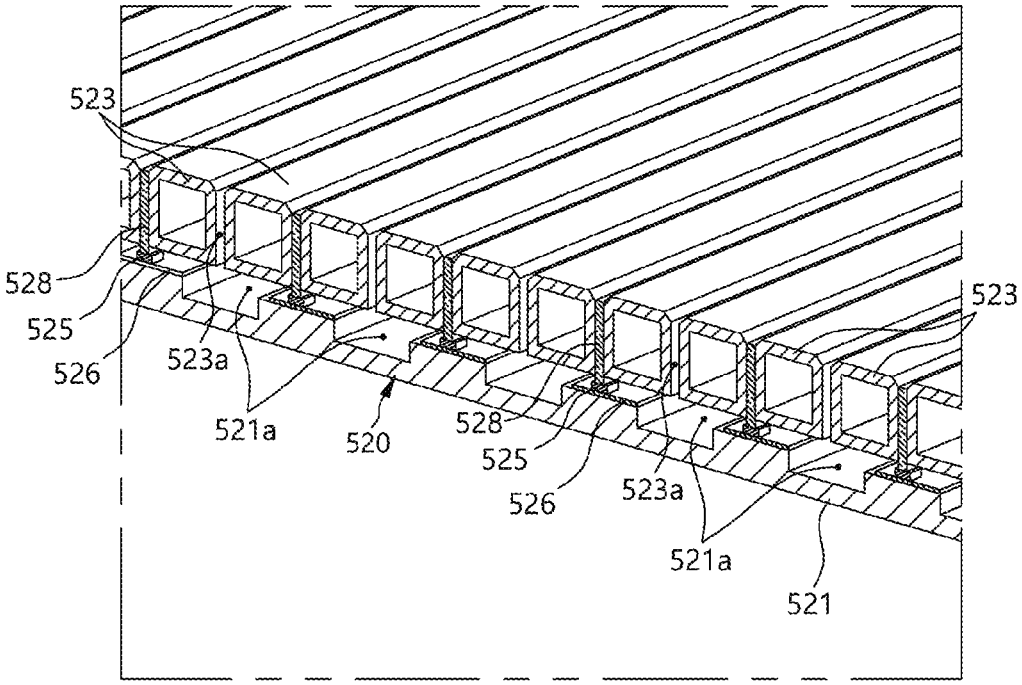
FIG. 10 is a cutaway perspective view illustrating the inner structure of the footrest of the hygiene management device for an entrance hall according to the embodiment of the present invention.
Figure 11:
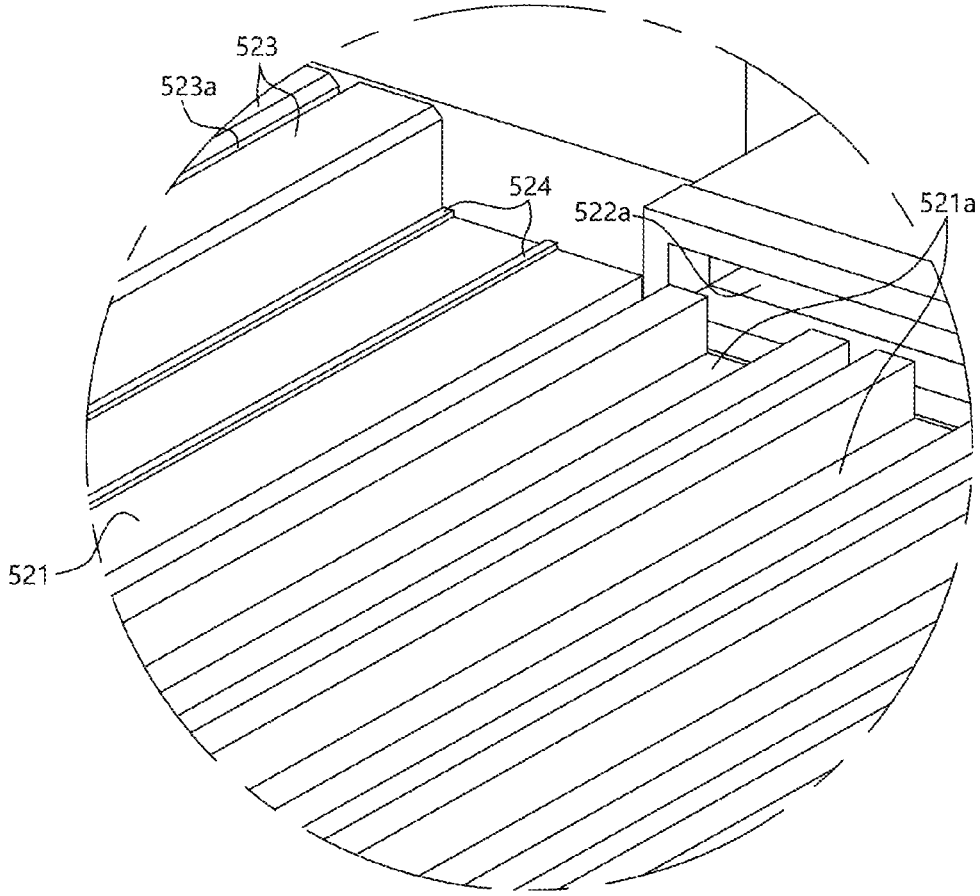
FIG. 11 is a perspective view illustrating the inner structure of the footrest of the hygiene management device for an entrance hall from which some support bars are omitted according to the embodiment of the present invention.
Figure 12:
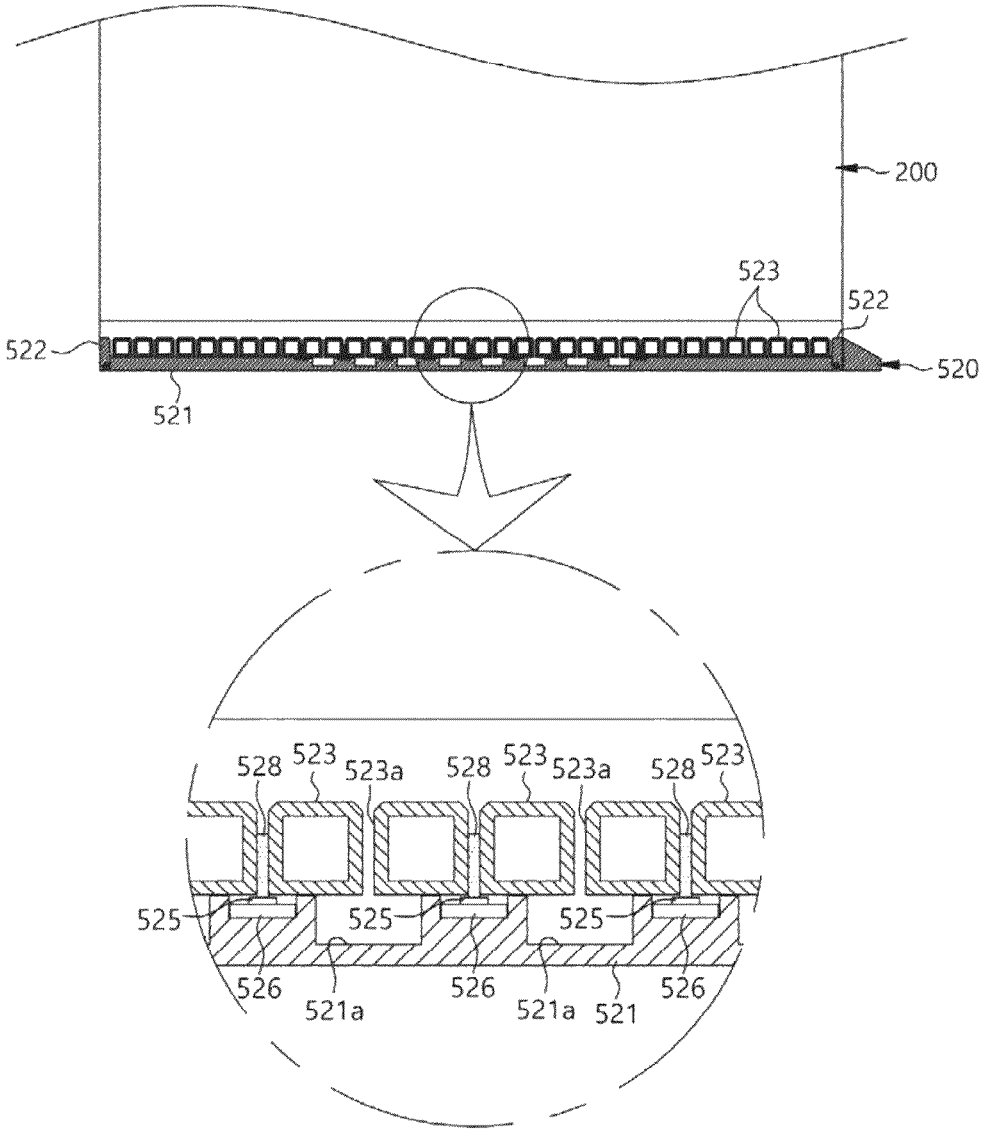
FIG. 12 is a front sectional view illustrating the inner structure of the footrest of the hygiene management device for an entrance hall according to the embodiment of the present invention.
Figure 13:
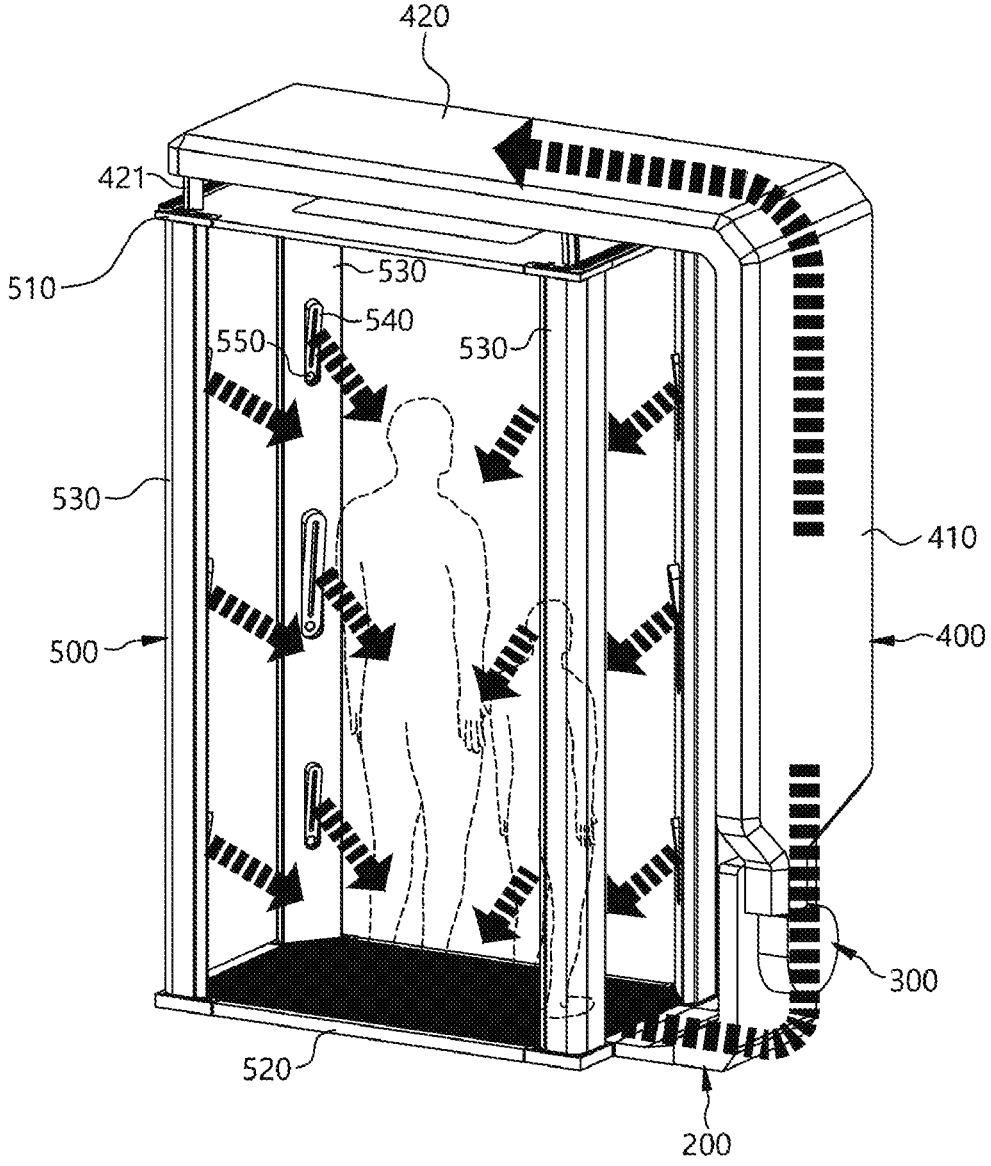
FIGS. 13 and 14 are views illustrating the operation states of a discharge nozzle part of the hygiene management device for an entrance hall according to the embodiment of the present invention.
Figure 14:
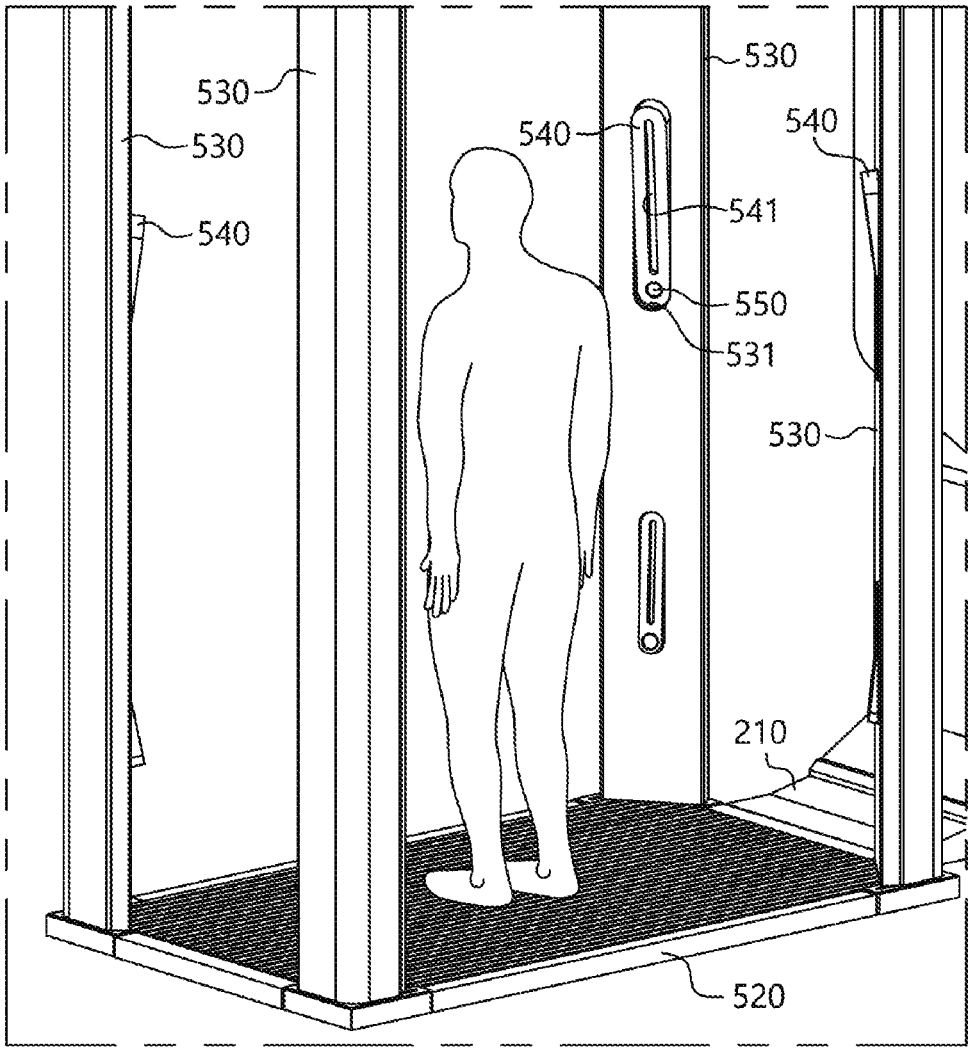
Figure 15:
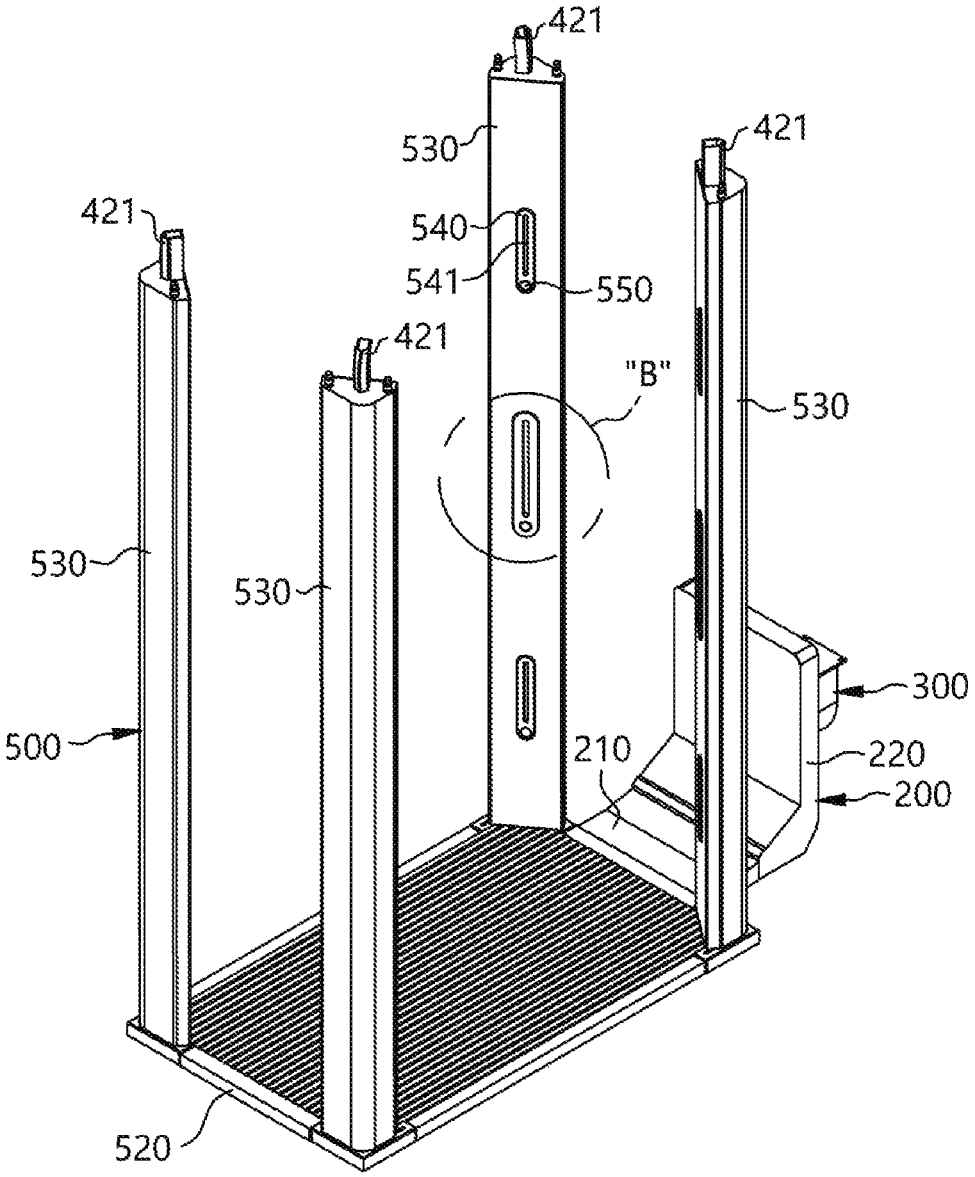
FIG. 15 is a perspective view of an air discharger of the hygiene management device for an entrance hall from which a top plate is omitted according to the embodiment of the present invention.
Figure 16:
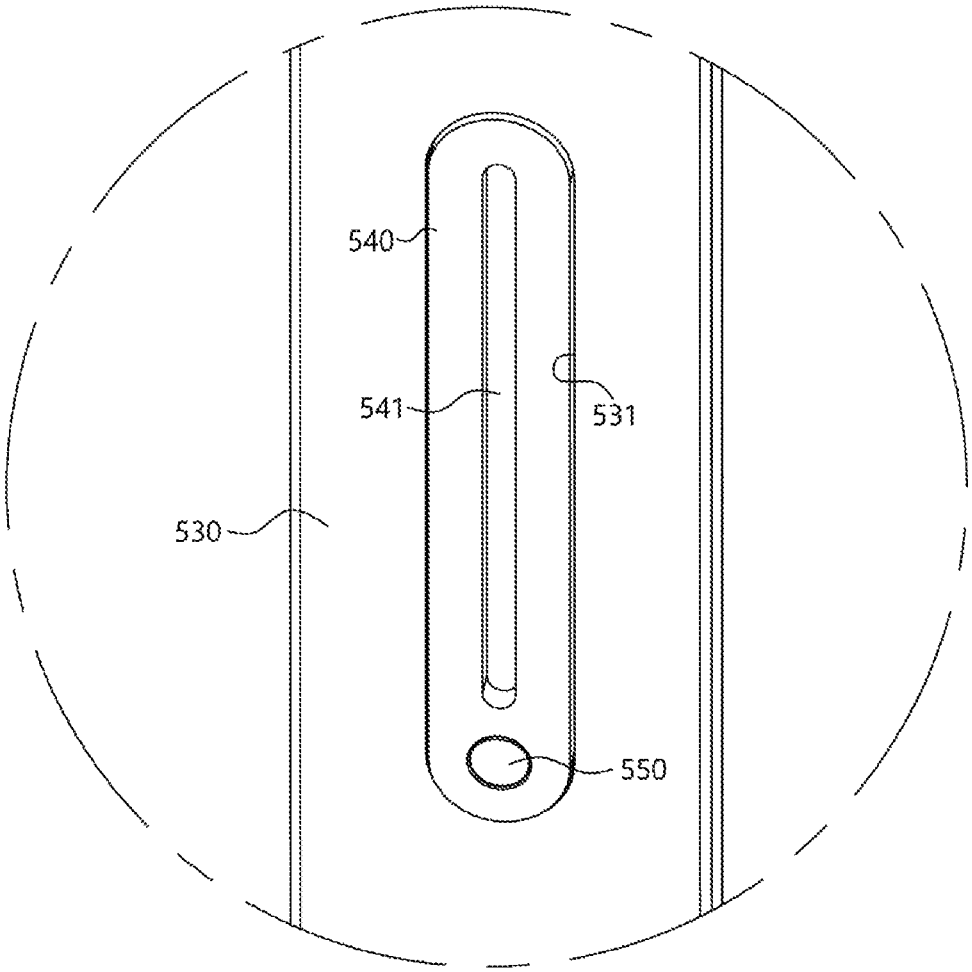
FIG. 16 is an enlarged view of a "B" part of FIG. 15.
Figure 17:
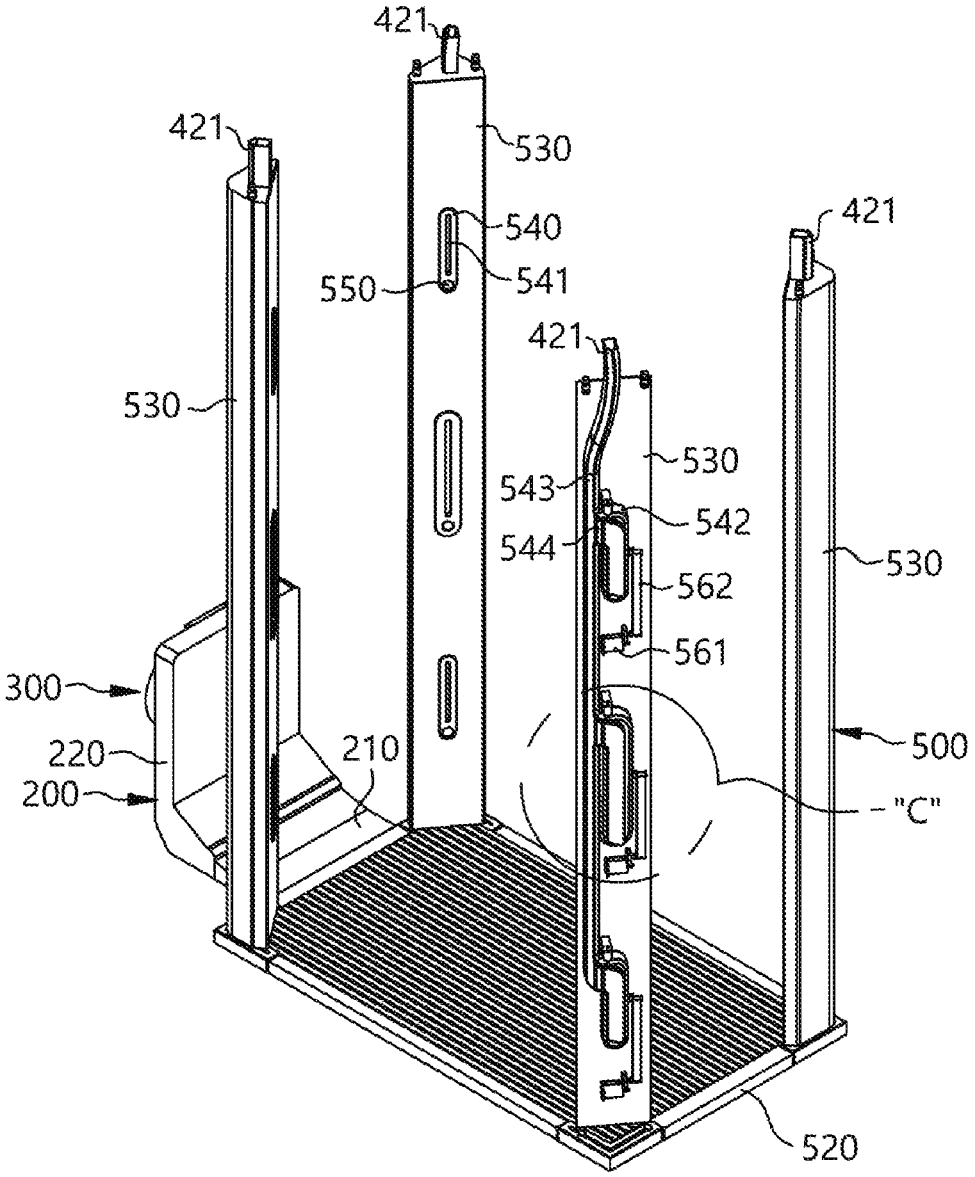
FIG. 17 is a perspective view illustrating a nozzle angle adjustment part of the air discharger of the hygiene management device for an entrance hall according to the embodiment of the present invention.
Figure 18:
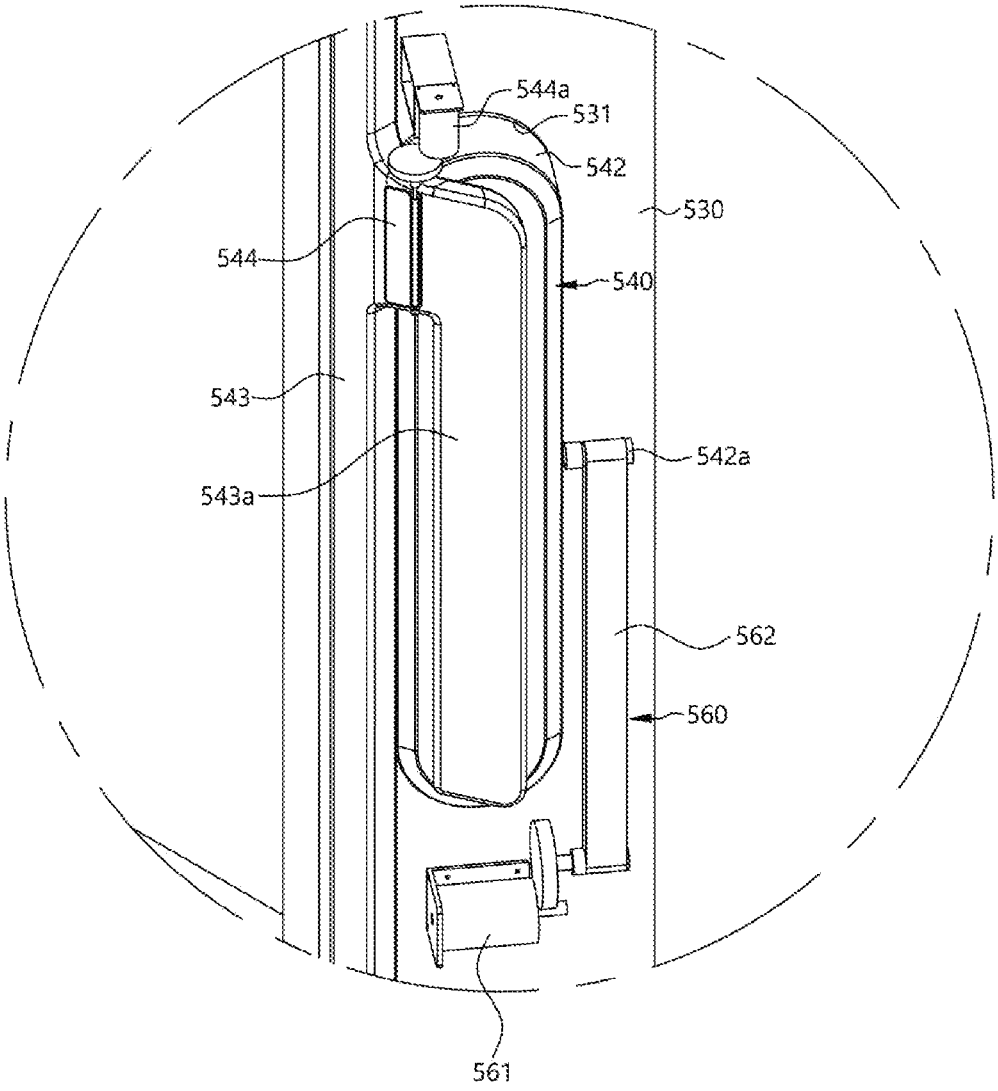
FIG. 18 is an enlarged view of a "C" part of FIG. 17.
Figure 19:
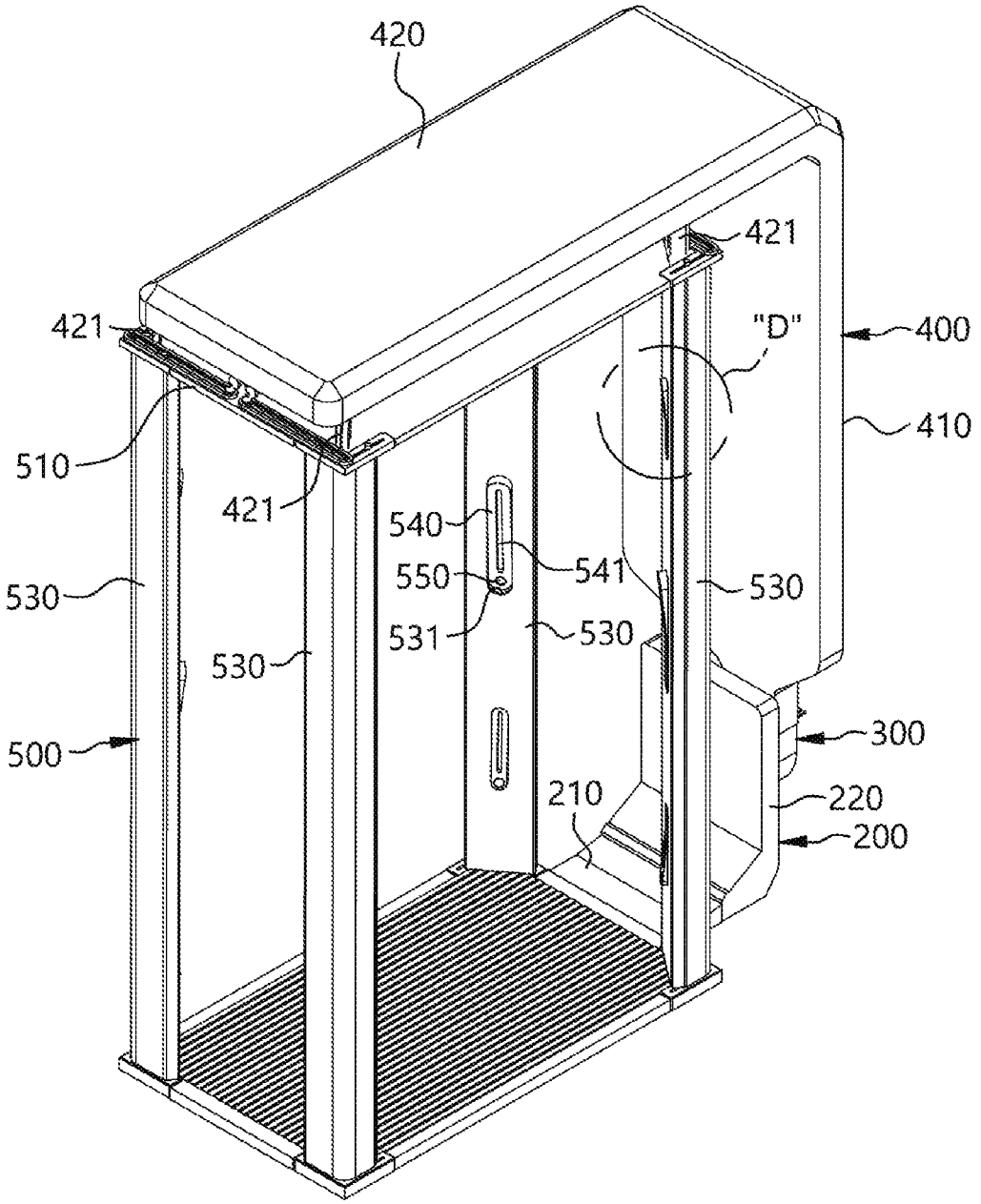
FIG. 19 is a perspective view illustrating the operation state of the nozzle angle adjustment part of the air discharger of the hygiene management device for an entrance hall according to the embodiment of the present invention.
Figure 20:
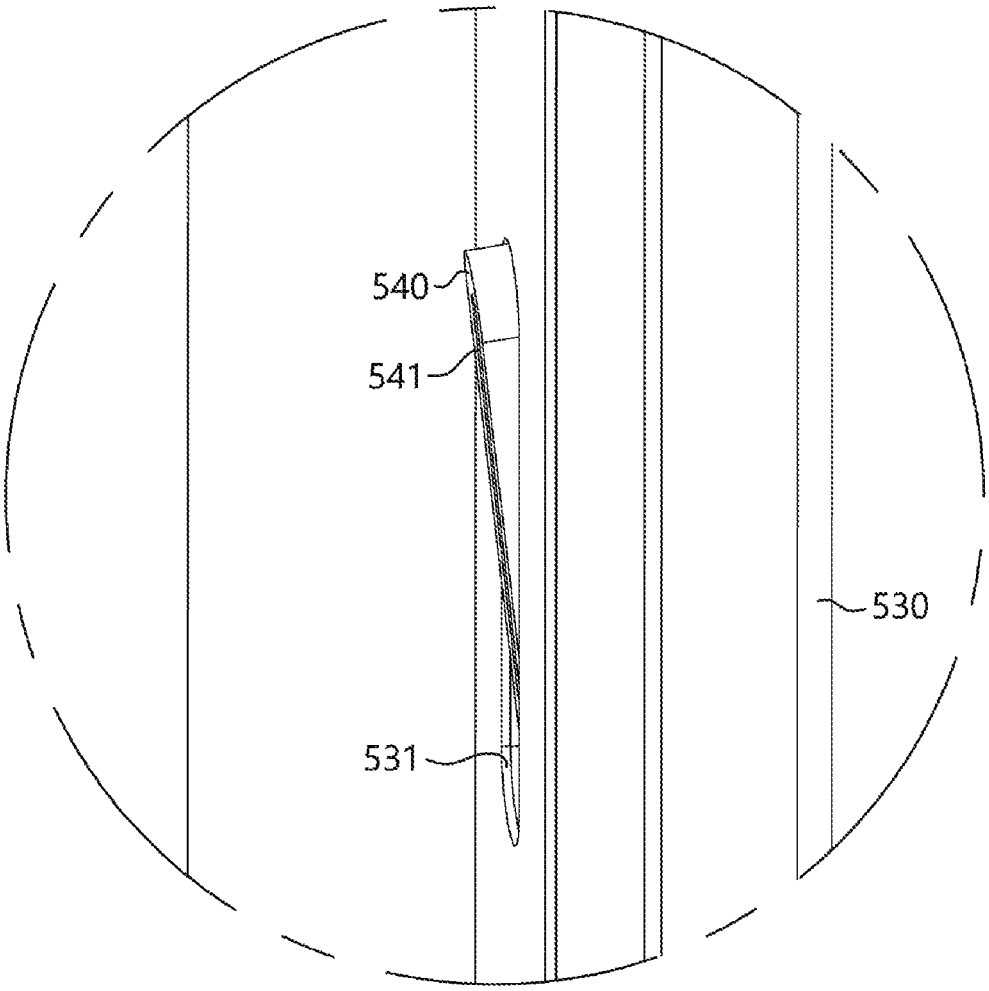
FIG. 20 is an enlarged view of a "D" part of FIG. 19.
Figure 21:
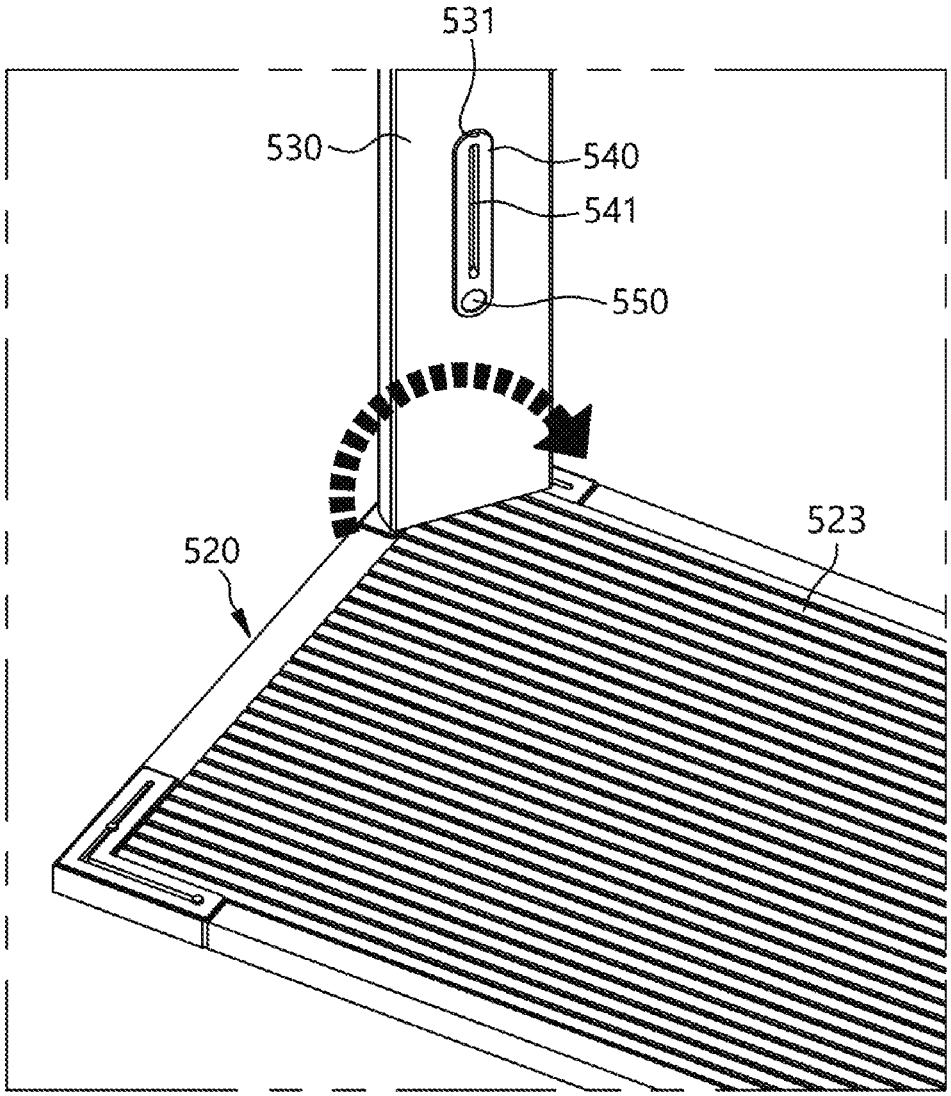
FIGS. 21 and 22 are perspective views illustrating the rotating states of a pillar frame of the hygiene management device for an entrance hall according to the embodiment of the present invention.
Figure 22:
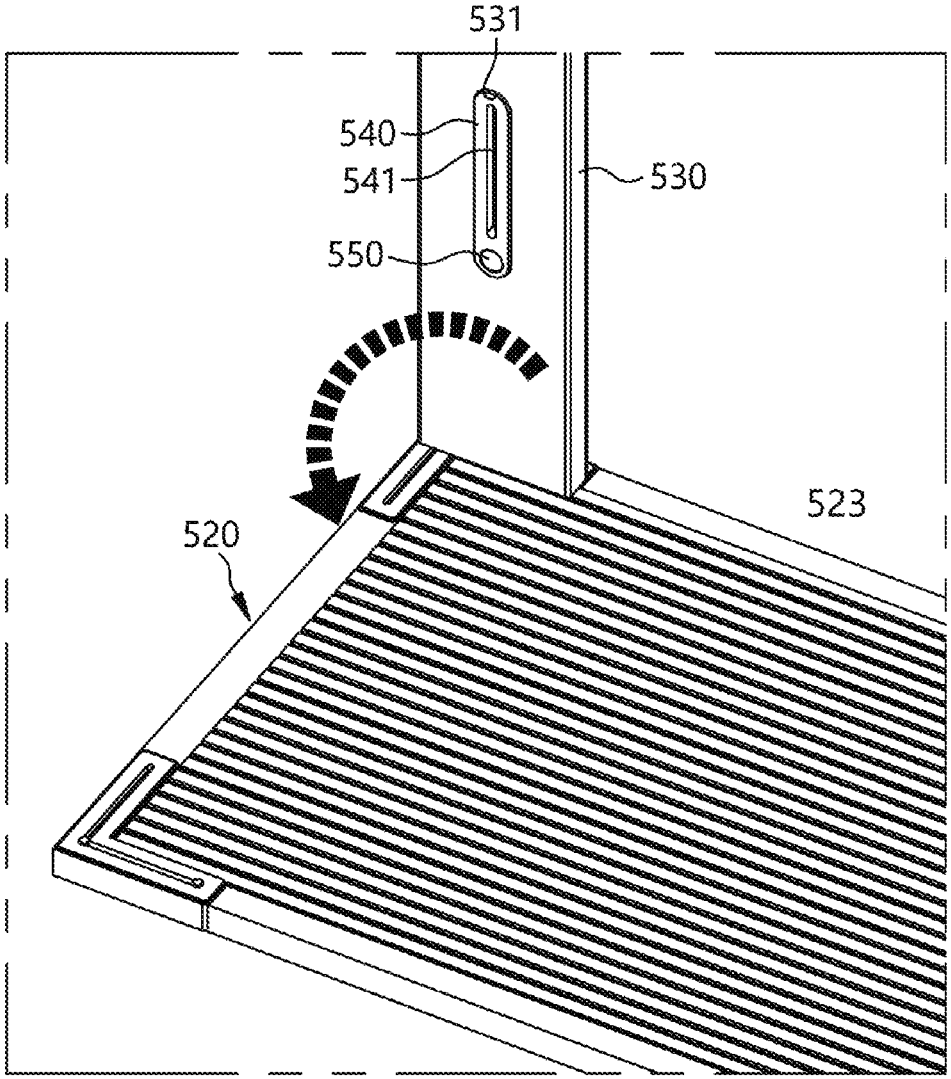
Figure 23:
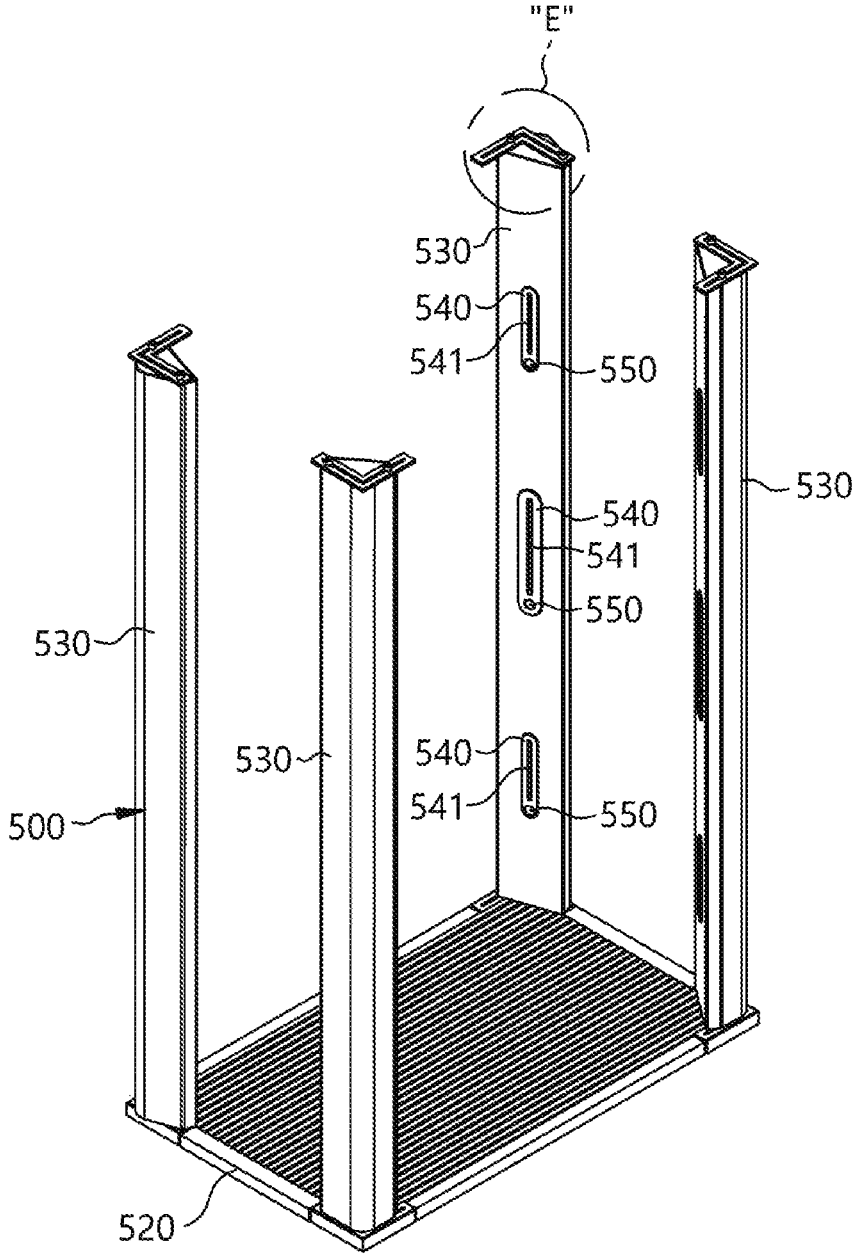
FIG. 23 is a perspective view illustrating a pillar rotating part of the hygiene management device for an entrance hall according to the embodiment of the present invention.
Figure 24:
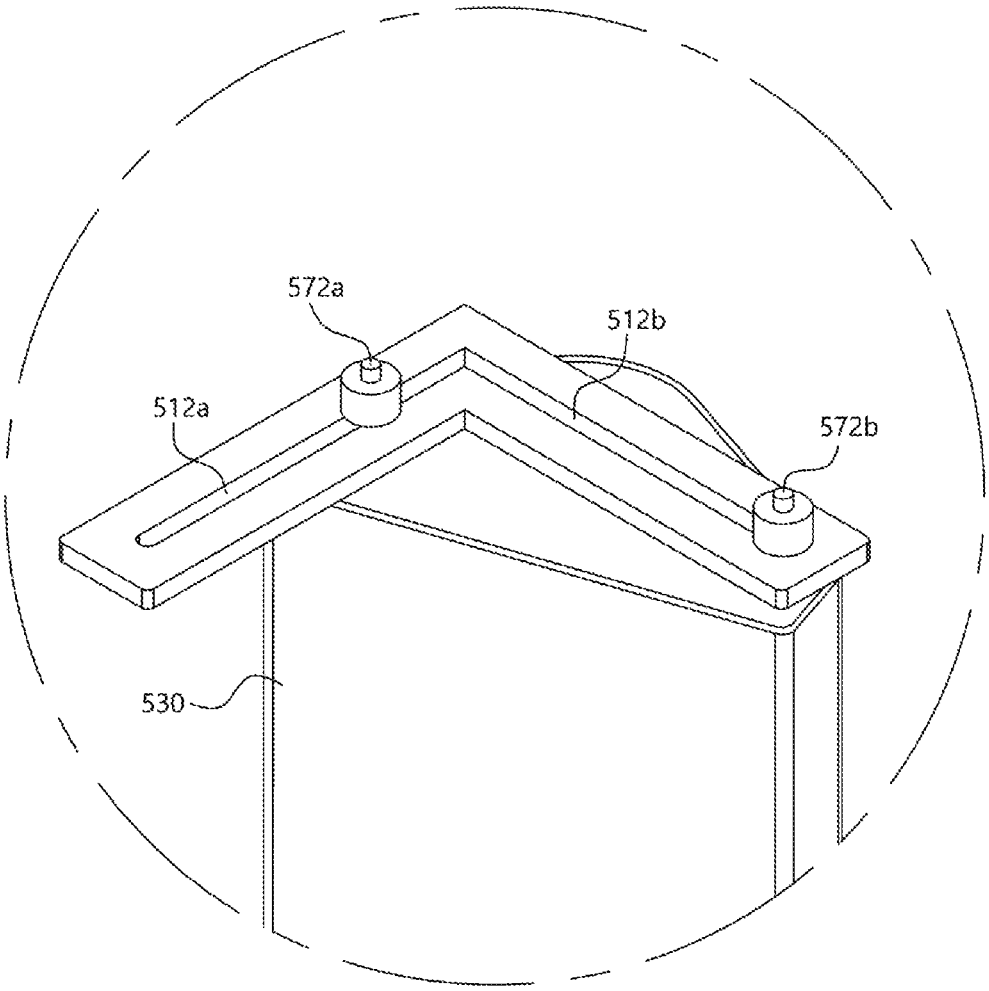
FIG. 24 is an enlarged view of an "E" part of FIG. 23.
Figure 25:
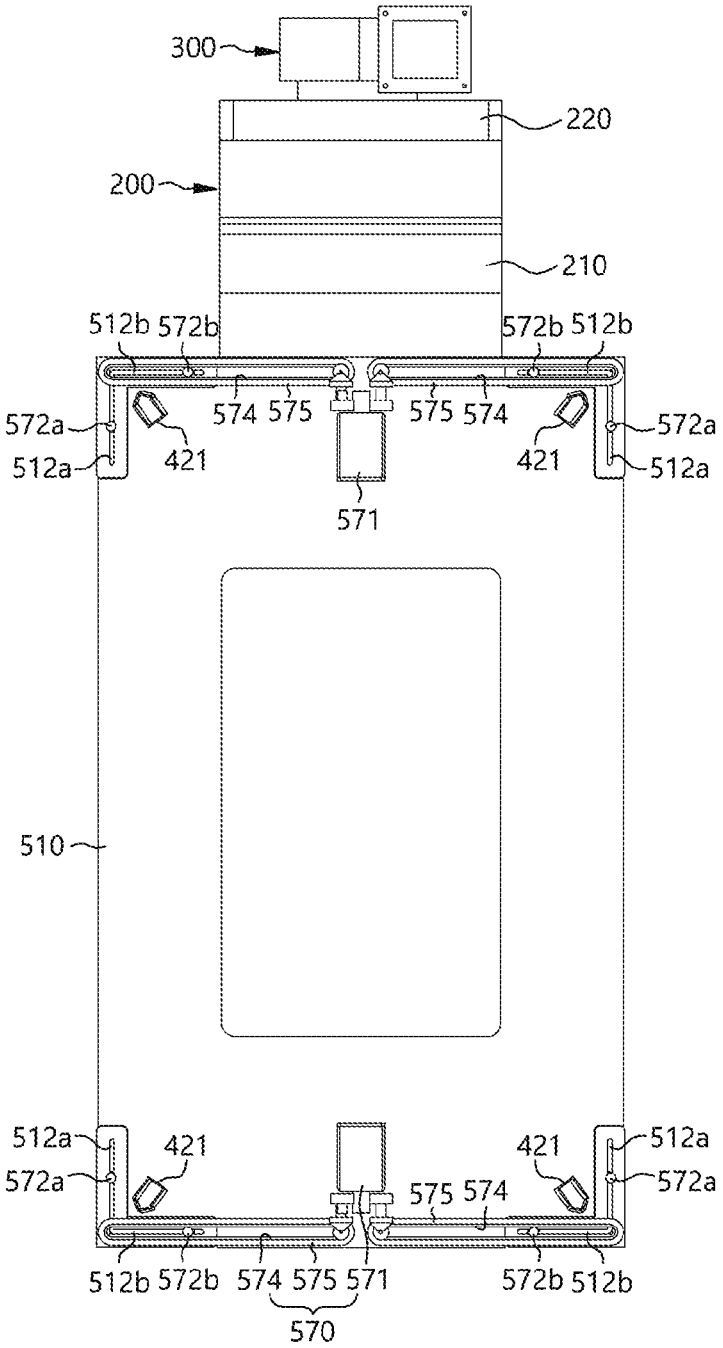
FIG. 25 is a top plan view of the hygiene management device for an entrance hall according to the embodiment of the present invention from which the duct unit is omitted.
Figure 26:
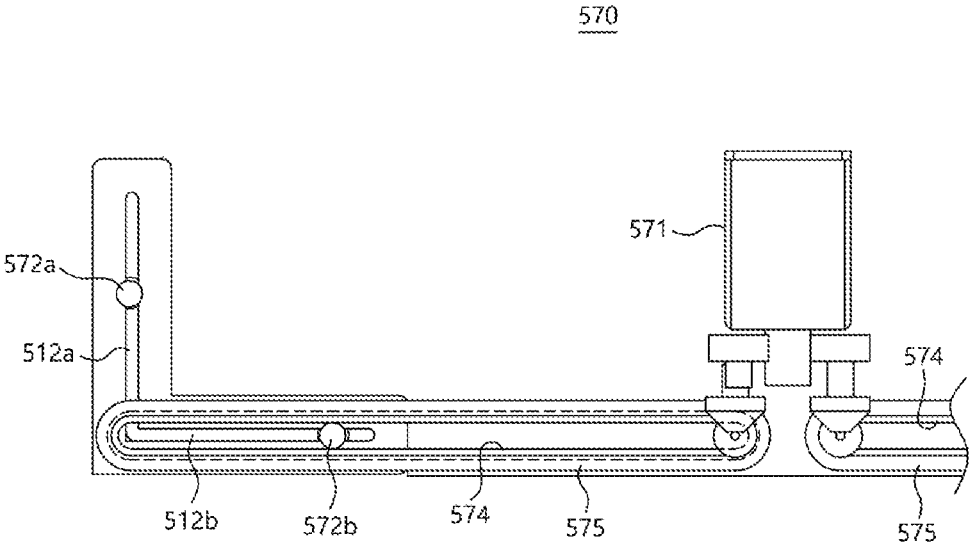
FIG. 26 is a top plan view illustrating the pillar rotating part of the hygiene management device for an entrance hall according to the embodiment of the present invention.
Figure 27:
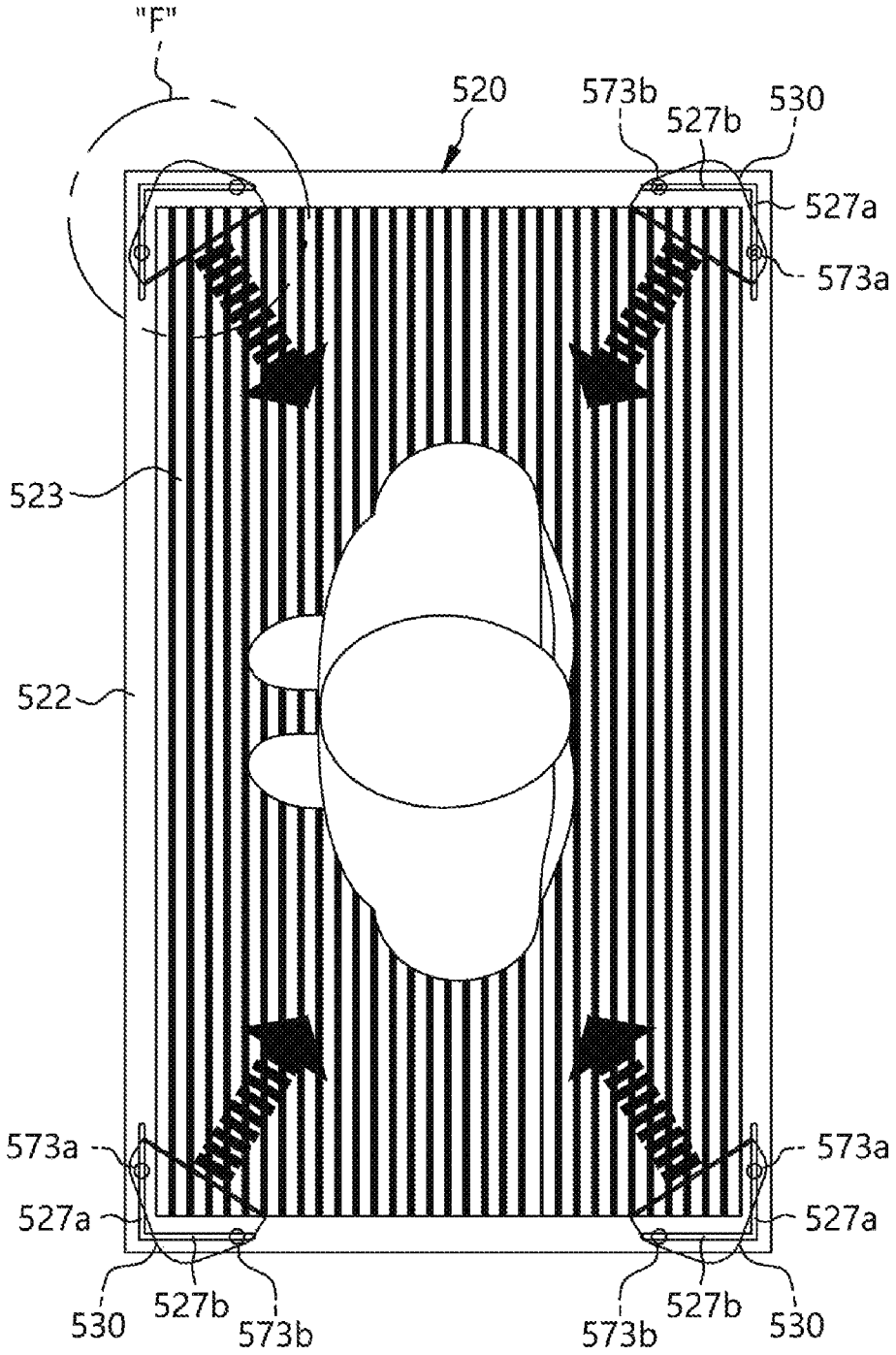
FIG. 27 is a view illustrating the operation state of the pillar frame for one position of a person in the hygiene management device for an entrance hall according to the embodiment of the present invention.
Figure 28:
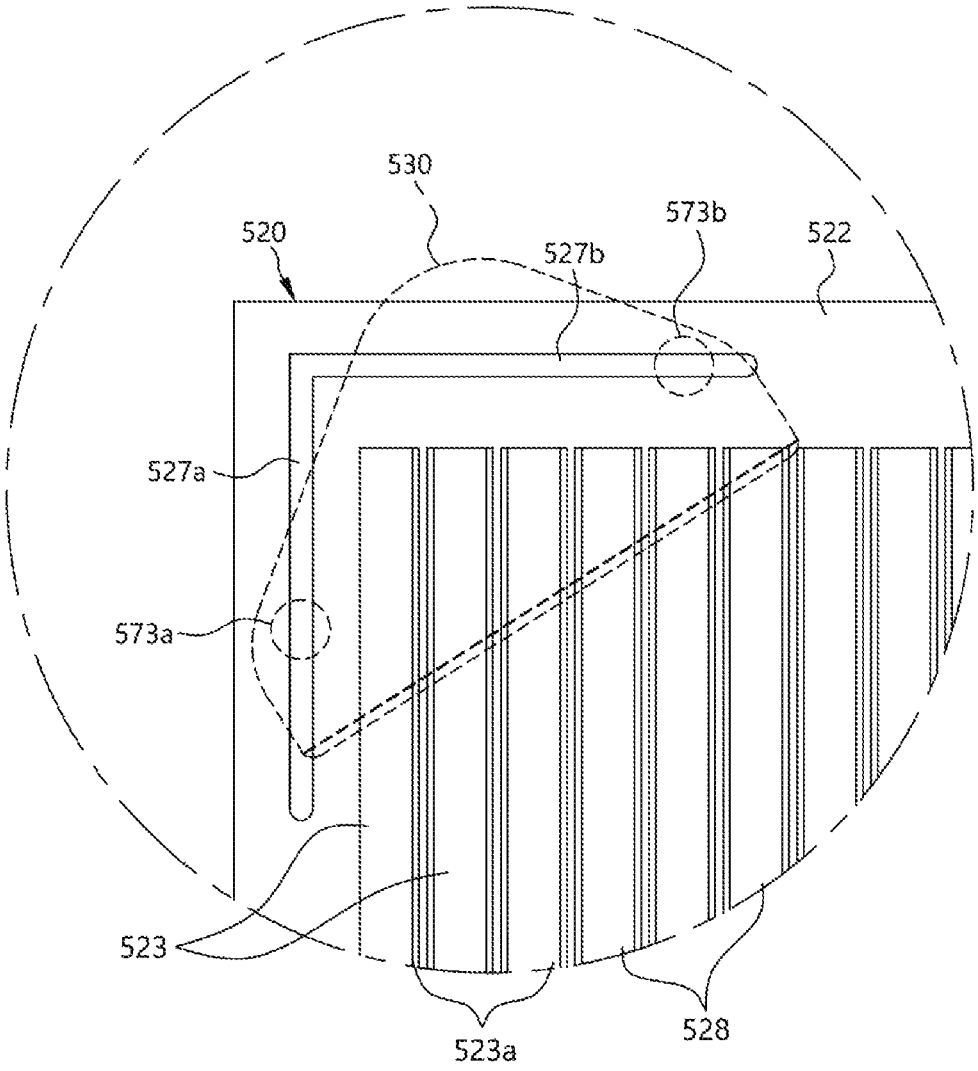
FIG. 28 is an enlarged view of an "F" part of FIG. 27.
Figure 29:
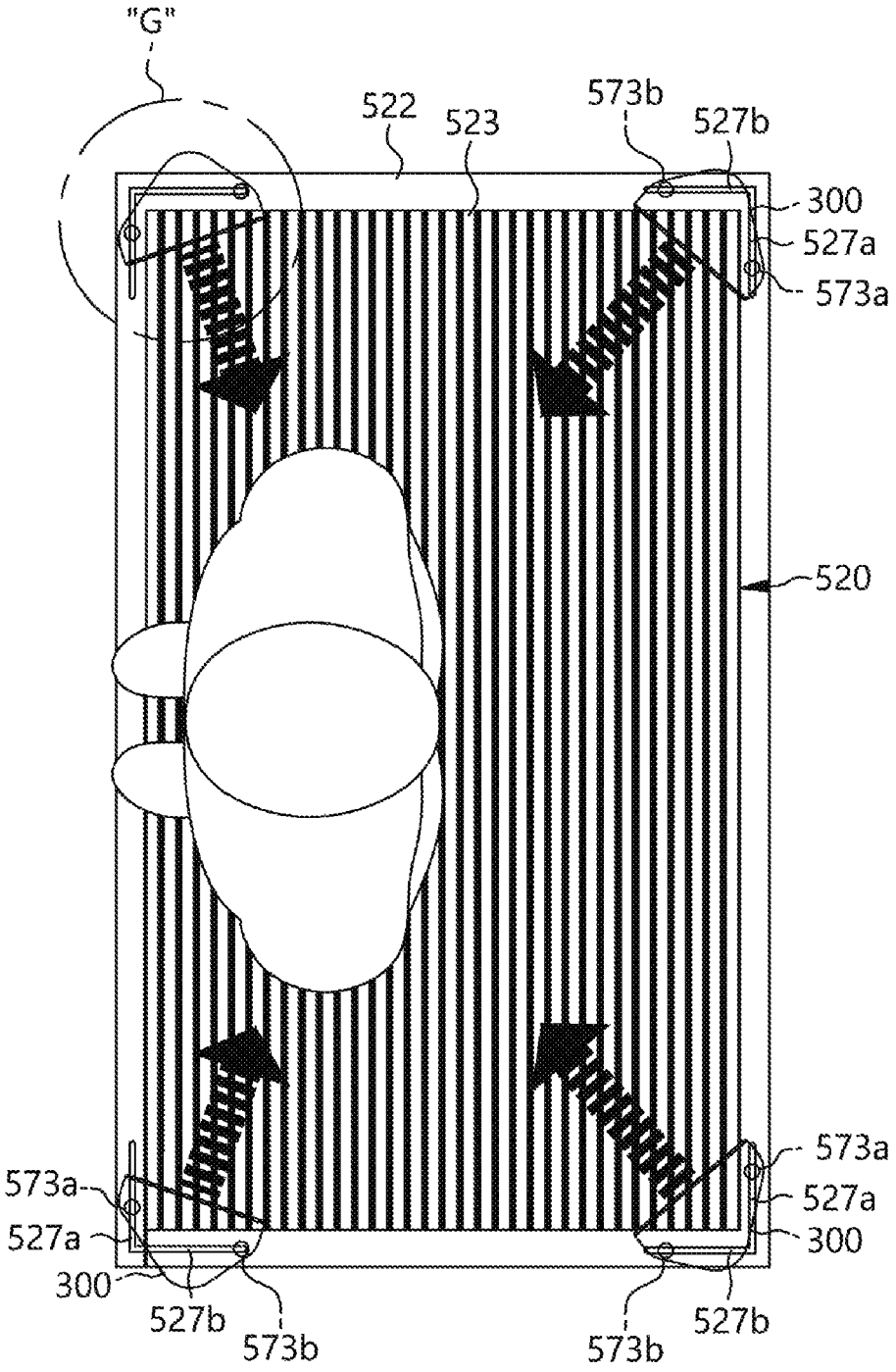
FIG. 29 is a view illustrating the operation state of the pillar frame for another position of a person in the hygiene management device for an entrance hall according to the embodiment of the present invention.
Figure 30:
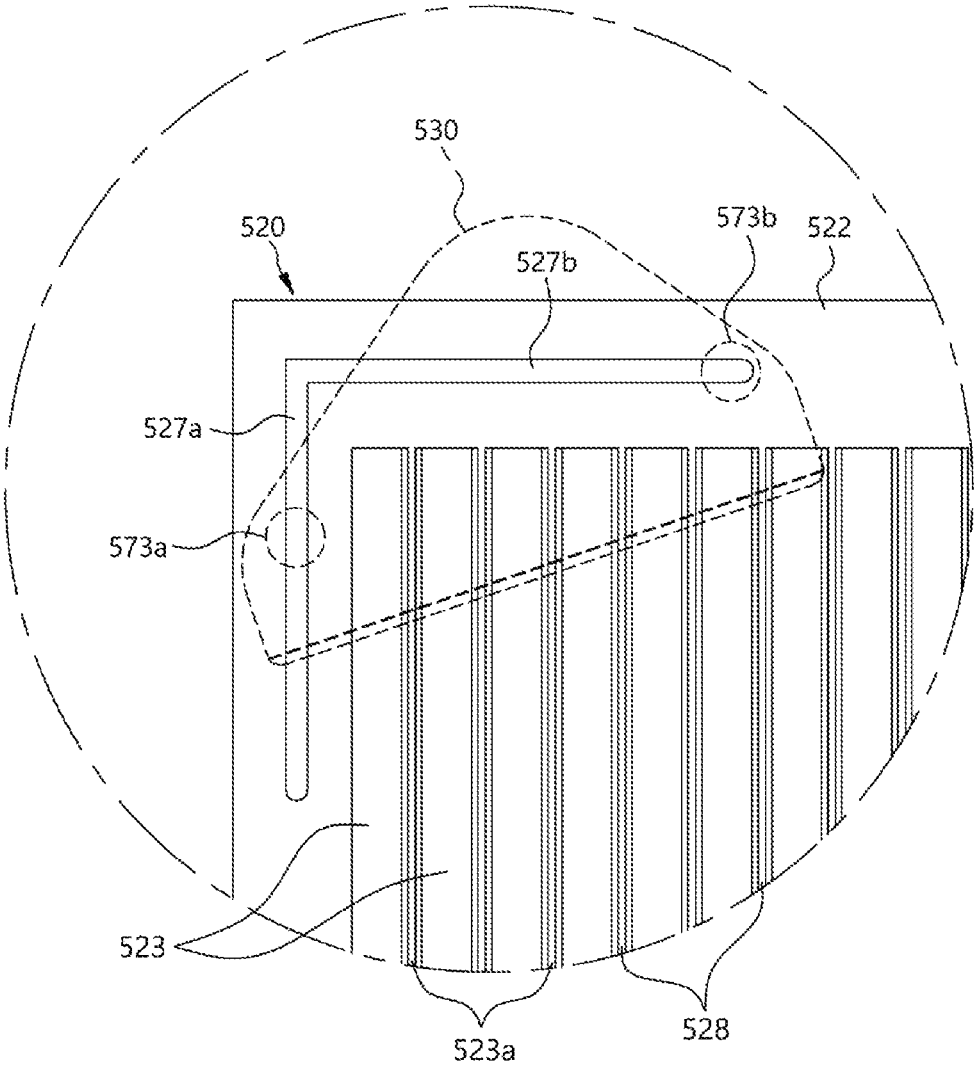
FIG. 30 is an enlarged view of a "G" part of FIG. 29.

FIG. 9 is a perspective view illustrating the footrest, and FIG. 10 is a cutaway perspective view illustrating the important part of the inner structure of the footrest. Furthermore, FIG. 11 is a perspective view of the important part of the inner structure of the footrest, and FIG. 12 is a sectional view of the important part of the inner structure of the footrest.

In these drawings, the footrest 520 is formed in the shape of a rectangular plate. However, according to the shape of the entrance space, the footrest 520 may have plate shapes having various shapes, such as a circle, an oval, a track type, and a polygon. Of course, at least one person may be located on the footrest 520 at the same time.

In addition, the footrest 520 may be configured to introduce the air of the entrance space to the footrest 520 by the operation of the fan assembly 300. That is, air introduction force generated by the operation of the fan assembly 300 may be supplied into the entrance space through the footrest 520.

To this end, the footrest 520 may include a base plate 521, a perimeter frame 522, and a plurality of support bars 523.

Here, the base plate 521 may constitute the frame of the associated footrest 520. That is, the base plate 521 may constitute the bottom of the footrest 520.

In addition, an introduction flow path 521*a* may be formed in the upper surface of the base plate 521. The introduction flow path 521*a* may be configured as a depressed groove such that air flows toward the air management module 200.

The introduction flow path 521*a* may include multiple introduction flow paths formed side by side to be spaced apart from each other.

Such introduction flow paths 521*a* may be formed in the entire portion of the base plate 521, or may be formed only in a portion of the base plate 521. In the embodiment of the present disclosure, it is exemplified that the introduction flow paths 521*a* are formed in an introduction area having a predetermined area. The introduction area may have an area large enough for at least one person to stand on.

The introduction flow path 521*a* may extend to the perimeter frame 522 of an edge of the base plate 521 and may be provided in plural. Specifically, the introduction flow path 521*a* may be configured to guide the flow of air toward the perimeter frame 522 located at the connection part of the introduction flow path 521*a* with the air management module 200.

The perimeter frame 522 may be formed by surrounding the edge of the base plate 521.

A communication flow path 522*a* may be formed in the perimeter frame 522 to communicate with each of the introduction flow paths 521*a* or less than all of the introduction flow paths 521*a*.

In addition, the fixed connection duct 210 of the air management module 200 may be connected to the communication flow path 522*a* and may be provided directly between the communication flow path 522*a* and the filter housing 220. Specifically, the inlet of the fixed connection duct 210 may be installed to pass through the perimeter frame 522 so as to communicate with the communication flow path 522*a*. Accordingly, air flowing through each of the introduction flow paths 521*a* may be supplied to the communication flow path 522*a* and then may be supplied to the air management module 200 through the fixed connection duct 210.

The support bar 523 may include multiple support bars 523, and the supports bars 523 may be installed to be parallel to the introduction flow paths 521*a* formed in the upper surface of the base plate 521. Further, the support bars 523 may be spaced from one another by a predetermined distance and may be spaced apart by one another by a guide rib 524, which is described below.

Each support bar 523 may be configured as a rectangular tube having a rectangular cross-section but may have any shape. That is, each support bar 523 may have a hollow shape to secure durability against external forces and reduce the weight of the entirety of the footrest 520 (i.e., have sufficient strength to resist external forces, such as the force due to a user standing on the footrest 520).

Particularly, each of the support bars 523 may be disposed to be spaced apart from each other and the introduction flow path 521*a* may be formed to be located at the lower portion of a gap between the support bars 523. There may a plurality of introduction flow paths 521, with each introduction flow path 521 being positioned below two adjacent support bars 523. That is, dust or foreign matter falling from a person may pass through the gap of each of the support bars 523 and may, together with air, be transferred to the introduction flow path 521*a*.

In this case, an introduction slot 523*a* may be formed in the gap between the support bars 523 adjacent to each other and may be configured such that air inside the entrance space is introduced into the introduction flow path 521*a* through the introduction slot 523*a*. That is, air may pass through the introduction slot 523*a* located between the support bars 523 adjacent to each other.

The introduction slot 523*a* may a width corresponding to the thickness of the support bar 523, and foreign matter larger than the width of the introduction slot 523*a* may be prevented from being introduced into the introduction flow path 521*a*. That is, the support bar 523 may function as a kind of filter which prevents relatively large foreign matter from being introduced into the introduction flow path 521*a*.

Of course, as the width of the introduction slot 523*a* (an interval between the support bars) increases, air introduction force acting on a side far from the communication flow path 522*a* in the associated introduction slot 523*a* may decrease. In consideration of such air introduction force, the width of the introduction slot 523*a* is preferably determined.

In addition, a guide rib 524 may be provided between each of the support bars 523. The guide rib 524 may define an interval between each of the support bars 523. That is, the thickness of the guide rib 524 may be an interval between the support bars 523 or the width of the introduction slot 523*a*.

In this case, the guide rib 524 may be partially provided between the support bars 523, and may be provided only in one portion between the support bars 523. Preferably, the guide rib 524 may be configured to have length shorter than the length of the support bar 523.

A UV light source 525 (see FIG. 10) for generating ultraviolet rays for sterilization and disinfection may be provided in at least a portion between the support bars 523. However, any alternative light source 525 may be used. The UV light source 525 may be mounted to a substrate 526, and the substrate 526 may be located in a portion of the introduction flow path 521*a*.

The substrate 526 may be installed on the upper surface of the base plate 521. Specifically, the substrate 526 may be placed on a position on the upper surface of the base plate 521 and between the introduction flow paths 521*a*. In this case, the UV light source 525 may be located between the support bars 523 under which the substrate 526 is installed. That is, a gap between the support bars 523 located at the upper side of the introduction flow path 521*a* may communicate with the associated introduction flow path 521*a*, and the UV light source 525 may be located between the support bars 523 placed on the upper surface of the base plate 521.

In addition, the UV light source 525 may provide a UV ray (or a plurality of UV rays) through a light guide plate 528, and the light guide plate 528 may be inserted into a gap between the support bars 523 between which the associated UV light source 525 is located.

Furthermore, the pillar frame 530 constituting the air discharger 500 is a part which connects the top plate 510 with the footrest 520 and discharges air to a person.

Of course, the pillar frame 530 may function to support the top plate 510.

Such a pillar frame 530 may include a plurality of pillar frames. The plurality of pillar frames 530 may be installed on at least two corners, respectively, of the top plate 510 or the footrest 520. In the embodiment of the present disclosure, the pillar frames 530 are installed on the four corners of each of the top plate 510 and the corners of the footrest 520 and may extend between the corners of the top plate 510 and the corners of the footrest 520, as an example.

A discharge nozzle part 540 which discharges air may be provided on the pillar frame 530. That is, after air guided by the duct unit 400 flows through the pillar frame 530, the air may be discharged through the discharge nozzle part 540 to a person.

Such a discharge nozzle part 540 may include a plurality of discharge nozzle parts, wherein the discharge nozzle parts may be located on the associated pillar frame 530 to be spaced apart from each other in the vertical direction of the associated pillar frame 530. That is, a sufficient amount of air may be discharged to all of a person's upper and lower bodies.

The discharge nozzle parts 540 may be configured to have the same sizes, or to have sizes different from each other. For example, when it is considered that there may be more foreign matter on a person's body than on the person's head, a discharge nozzle part located at the center portion of the pillar frame 530 may be configured to discharge more air than discharge nozzle parts located at other portions of the pillar frame 530.

FIGS. 13 to 20 illustrate the installed structure of the discharge nozzle parts 540.

Each of the discharge nozzle parts 540 may be configured such that air is selectively supplied thereto. That is, only some discharge nozzle parts 540 may be controlled to discharge air or alternatively, all of the nozzle parts 540 may be controlled to discharge air.

Such a selective air discharge structure may prevent air from being discharged to a person's face such that discomfort and unpleasantness caused by air discharged to respiratory organs (a mouth and a nose) can be prevented.

To this end, the air discharger 500 may include a detector 550 which detects a person's height or face position.

The detector 550 may be configured as a face recognition camera. That is, the position of a person's face or a person's height may be detected by the detector 550. Of course, the detector 550 may be configured to include a plurality of optical sensors so as to detect a person's height.

The detector 550 described above may be provided in each of the discharge nozzle parts 540. That is, the detector 550 may be provided in each of the discharge nozzle parts 540 so as to more accurately detect person's height and face position.

The detector 550 may be provided in the pillar frame 530, may be provided in the entrance hall, or may be provided in both the pillar frame 530 and the discharge nozzle part 540.

In addition, the detector 550 may also detect whether a person has entered. For example, when a person is detected by the detector 550, the blower fan 320 may be configured to be operated.

Furthermore, each of the discharge nozzle parts 540 may be configured to adjust the upward/downward discharge direction of air (i.e., the vertical direction in which the pillar frame 530 extends in). That is, due to the selective operation control of each of the discharge nozzle parts 540, unnecessary air discharge toward a position higher than a person's height may be prevented, and due to the discharge direction adjustment of each of the discharge nozzle parts 540, air discharge directly to a person's respiratory organ (i.e., air discharged directly to a person's mouth or face) may be prevented.

For example, when a person is a short person, such as a child, among a plurality of discharge nozzle parts 540, a discharge nozzle part 540 located at a position higher than the height of the associated person may not discharge air. In addition, the discharge nozzle part 540 located at the same height as a person's face or at a height similar thereto may be prevented from discharging air to the person's face through the angle adjustment of the discharge nozzle part 540.

To this end, the discharge nozzle part 540 may include a discharge casing 542 in which a discharge hole 541 through which air is discharged is formed. In this case, an exposure hole 531 may be formed in the pillar frame 530, and the discharge casing 542 may be installed to be exposed to the outside (a side at which a person is positioned) of the pillar frame 530 by passing through the exposure hole 531.

The discharge casing 542 may be configured to receive air from an air transfer duct 543. The air transfer duct 543 is a duct which receives air from the second duct 420 and transfers the air to the discharge casing 542, and may be installed along the inside of the pillar frame 530.

The air transfer duct 543 may be configured to receive air from the second duct 420 through a guide tube 421. For example, the guide tube 421 extending from the second duct 420 may be connected to the air transfer duct 543. A plurality of guide tubes 421 may be provided, with each guide tube 421 installed to pass through a respective one of the corners of the top plate 510 by protruding from the lower surface of the second duct 420. That is, the plurality of guide tubes 421 pass through the corners of the top plate 510 (i.e., four corners of the top plate 510).

In this case, a through hole 511 may be formed in each of the corners of the top plate 510 such that the guide tube 421 passes through the through hole 511, and in the upper surface of the pillar frame 530, a portion facing the through hole 511 may be formed to be open.

Furthermore, the guide tube 421 and the air transfer duct 543 may be connected to each other directly or by a separate bendable tube.

Furthermore, the air transfer duct 543 may be configured to have a plurality of branch pipes 543*a* (see FIG. 18) connected respectively to the discharge casings 542. That is, each of the branch pipes 543*a* branching from the air transfer duct 543 may be connected to each of the discharge casings 542, respectively.

Particularly, a flow path opening/closing valve 544 configured to open/close the associated flow path may be provided in the connection portion of the branch pipe 543*a* with the discharge casing 542. The flow path opening/closing valve 544 may be configured as a valve operated by electrical control. For example, as illustrated in the drawing, the flow path opening/closing valve 544 may be configured as a shutter structure operated by a motor 544*a*, and may be configured as a solenoid valve, or any other known valve.

Of course, the flow path opening/closing valve 544 may be configured to manually or automatically close or open the flow path.

Furthermore, the discharge casing 542 may be installed to perform the upward/downward inclination adjustment. That is, a rotation shaft 542*a* may be mounted to each of the opposite wall surfaces of the discharge casing 542 such that the discharge casing 542 rotates upward/downward in the portion of the pillar frame 530 in which the exposure hole 531 is formed.

The connection portion between the branch pipe 543*a* of the air transfer duct 543 and the discharge casing 542 may be configured to be bendable. Of course, the entirety of the air transfer duct 543 may be formed of a bendable material. For example, the air transfer duct 543 may be configured as a corrugated pipe or hose.

The discharge casing 542 may be configured such that the upward/downward inclination adjustment thereof is performed by a nozzle angle adjustment part 560. That is, a user does not manipulate the angle of the discharge casing 542, but the discharge casing 542 may be configured such that the angle of the discharge casing 542 is automatically adjusted by the nozzle angle adjustment part 560.

The nozzle angle adjustment part 560 may be configured to rotate the rotation shaft 542*a* mounted to the discharge casing 542 clockwise/counterclockwise. Specifically, the nozzle angle adjustment part 560 may include an angle adjustment motor 561, wherein the angle adjustment motor 561 may be connected to the rotation shaft 542*a* directly or by a power transmission member 562 such that power is transmitted therebetween.

In the embodiment of the present disclosure, the angle adjustment motor 561 is configured to transmit power to the rotation shaft 542*a* through the power transmission member 562, as an example. In this case, the power transmission member 562 may be a chain or a belt. The angle adjustment motor 561 and the rotation shaft 542*a* may be configured to be engaged with each other by gears, such that power is transmitted therebetween.

Particularly, the angle adjustment motor 561 of the nozzle angle adjustment part 560 may be configured to be provided in each of the discharge nozzle parts 540. That is, since an air discharge angle is required to be changed according to a person's height or face position, each of the discharge nozzle parts 540 is preferably provided with the angle adjustment motor 561.

One angle adjustment motor 561 may be configured to simultaneously operate a plurality of discharge nozzle parts 540 (discharge casings) provided in the associated pillar frame 530.

The discharge casing 542 may be configured to be inclined upward and downward by an actuator or a structure using hydraulic pressure.

FIGS. 21 to 30 illustrate the rotation structure of the pillar frame 530.

As illustrated in these drawings, the pillar frame 530 may be configured to rotate toward opposite sides relative to the top plate 510 or the footrest 520.

That is, the upper surface of the pillar frame 530 may be rotate toward opposite sides relative to the top plate 510, or the lower surface of the pillar frame 530 may be configured to rotate toward opposite sides relative to the footrest 520. Accordingly, the pillar frame 530 may continuously discharge air toward a person when the person passes the hygiene management device for an entrance hall, such that contaminants are efficiently removed from the person.

All of the plurality of pillar frames 530 may be configured to rotate toward opposite sides. That is, according to the position of a person, the discharge nozzle part 540 (or the discharge hole) provided on each of the pillar frames 530 may discharge air toward the person. Accordingly, even if a person is located at one side of the upper surface of the footrest 520, air may be discharged toward the person.

Furthermore, to rotate the pillar frame 530, a pillar rotating part 570 may be provided on the upper surface of the top plate 510.

The pillar rotating part 570 may include a rotary motor 571 and may be configured to adjust the rotation angle of the pillar frame 530. That is, due to the operation of the rotary motor 571, the pillar frame 530 may rotate toward opposite sides relative to the top plate 510 or the footrest 520 such that the discharge nozzle part 540 (or the discharge hole) is directed to a person. Accordingly, even if a person passes the hygiene management device for an entrance hall without stopping, the discharge nozzle part 540 may move to be directed toward the person so as to discharge a sufficient amount of air toward the person. Of course, even if a person moves to any one side of the footrest 520, a sufficient amount of air may be discharged to the person.

In the pillar frames 530, only some pillar frames 530 may be configured to rotate toward opposite sides. For example, two pillar frames 530 located at the opposite sides of the front side relative to the moving direction of a person may be fixedly located to face each other, and two pillar frames 530 located at the opposite sides of the rear side relative to the moving direction thereof may be configured to rotate. Alternatively, the two pillar frames 530 located at the opposite sides of the front side may be configured to rotate, and the two pillar frames 530 located at the opposite sides of the rear side may be fixedly located to face each other.

The pillar rotating part 570 may include rollers 572*a*, 572*b*, 573*a*, and 573*b*.

That is, the rotation of the pillar frame 530 may be supported by the rollers 572*a*, 572*b*, 573*a*, and 573*b*.

These rollers 572*a* and 572*b*, or 573*a* and 573*b* may be provided on at least one of the surface of the pillar frame 530 opposing to the top plate 510 and the surface of the pillar frame 530 opposing to the footrest 520, respectively.

For example, the upper rollers 572*a* and 572*b* may be provided on the upper surface of the pillar frame 530. In this case, upper guide grooves 512*a* and 512*b* may be formed in the top plate 510 such that the upper rollers 572*a* and 572*b* are received in the upper guide grooves 512*a* and 512*b*, respectively, to move.

Alternatively, lower rollers 573*a* and 573*b* may be provided on the lower surface of the pillar frame 530. In this case, lower guide grooves 527*a* and 527*b* may be formed in the footrest 520 such that the lower rollers 573*a* and 573*b* are received in the lower guide grooves 527*a* and 527*b*, respectively, to move.

It may be preferable that the upper rollers 572*a* and 572*b*, and the lower rollers 573*a* and 573*b* are provided on the upper and lower surfaces, respectively, of the associated pillar frame 530 such that the pillar frame 530 rotates uniformly in upper and lower portions thereof.

Particularly, the rollers 572*a* and 572*b* of the upper surface of the pillar frame 530, and the rollers 573*a* and 573*b* of the lower surface of the pillar frame 530 may include a plurality of rollers, respectively, and the rollers 572*a* and 573*a*, and 572*b* and 573*b* of the surfaces may be configured to move respectively in different directions. For example, the rollers 572*a* and 573*a* of the upper and lower surfaces, respectively, may be configured to move respectively along the guide groove 512*a* and 527*a* formed in the respective sides of the top plate 510 and the footrest 520, and the other rollers 572*b* and 573*b* of the upper and lower surfaces, respectively, may be configured to move respectively along the guide grooves 512*b* and 527*b* formed in the respective other sides of the top plate 510 and the footrest 520.

Due to the arrangement of each of the rollers 572*a*, 572*b*, 573*a*, and 573*b*, when a person passes between two pillar frames 530, the two pillar frames 530 may be located to face each other, and after a person passes between two pillar frames 530, the two pillar frames 530 may rotate and may be located to be directed to the person.

The pillar rotating part 570 may include a drive member 574 which transmits the driving force of the rotary motor 571 to any one roller 572*a*.

That is, at least any one roller 572*a* or 573*a* of the rollers 572*a*, 572*b*, 573*a*, and 573*b* of the pillar frame 530 may be configured to receive power through the rotary motor 571 and the drive member 574.

In this case, due to a drive member case 575, the drive member 574 may rotate along a predetermined path to forcibly rotate any one roller 572*a*. In addition, a rack gear may be formed on the inner surface of any one upper guide groove 512*a*, and the upper roller 572*a* may be configured as a pinion gear engaging with the rack gear.

That is, the roller 572*a* may be configured to be forcibly rotated by the drive member 574 and to move along the rack gear. In this case, the roller 572*b* of the associated pillar frame 530 may be installed to roll along the inner surface of the upper guide groove 512*b* (a groove formed in a direction perpendicular to the one upper guide groove).

The roller 572*a* may be configured to be forcibly moved along any one side of the top plate 510 by an actuator such that the associated pillar frame 530 can rotate at the corner of the top plate 510.

Any one roller 572*a* may be connected to the rotary motor 571 by a chain or gear so as to receive the power of the rotary motor 571.

Meanwhile, the hygiene management device for an entrance hall according to the embodiment of the present disclosure may include a controller (i.e., a hardware embedded processor).

The controller may be configured to acquire various information for hygiene management through various hardware embedded sensors and to control the operation of each operation element by using the acquired information.

For example, the controller may check whether a person enters, the person's height or face position, and the person's position through information detected by the detector 550.

The controller may control air blowing and the rotation of each of the pillar frames 530. That is, the blower fan 320 and the rotary motor 571 maybe operated by the control of the controller.

The controller may control an air discharge direction. That is, the angle adjustment motor 561 maybe operated by the control of the controller.

The controller may control the air discharge of the discharge nozzle part 540 according to a person's height. That is, the controller may control the flow path opening/closing valve 544 provided in each of the discharge nozzle parts 540 such that air can be selectively discharged through each of the discharge nozzle parts 540.

Various embodiments described herein may be implemented in a computer-readable medium using, for example, software, hardware, or some combination thereof. For example, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions may be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

Hereinafter, the operation of the hygiene management device for an entrance hall according to the embodiment of the present disclosure described above will be described.

When a person enters the entrance space and stands on the footrest 520, the detector 550 may detect the person.

Of course, the person may be detected by a sensor in addition to the detector 550. For example, a sensor which detects the opening of an entrance door (an outside door) or a motion sensor provided in the entrance space may detect the entering of a person, as known in the art.

In addition, when the entering of a person is detected by the detector 550, the controller may operate the blower fan 320 on the basis of the detected information. Accordingly, the air blowing force may be generated. Of course, from the time when the outside door is opened, the controller may control the blower fan 320 such that the blower fan 320 is operated.

Furthermore, when the air blowing force is generated due to the operation of the blower fan 320, air introduction force is transmitted through the air management module 200 and the footrest 520 to the entrance space, and thus the air of the entrance space may be transferred through the introduction flow paths 521*a* of the footrest 520 to the air management module 200.

That is, the air may flow through the introduction slots 523*a* located between the support bars 523 of the footrest 520 into the introduction flow paths 521*a*, and may be collected in the communication flow path 522*a*, and then may be transferred through the fixed connection duct 210 to the air management module 200.

Furthermore, while the air transferred to the air management module 200 flows through the filter housing 220, the air may pass through the filters 223. In this case, while the air passes through the filters 223, foreign matter and moisture contained in the air may be removed.

In addition, while the air passing sequentially through the filters 223 passes through the heat exchanger or heater, the temperature of the air may rise (lower) to preset temperature.

Continuously, the air may be introduced through the filter housing 220 into the fan housing 310. Additionally, the air introduced into the fan housing 310, by the guidance of the blower fan 320, may pass through the associated fan housing 310 and may be supplied sequentially to the first duct 410 and the second duct 420.

In addition, the air supplied to the second duct 420 may be supplied through the guide tubes 421 to the air transfer duct 543 located in each of the pillar frames 530. Continuously, the air supplied to the air transfer duct 543 may be supplied through each of the branch pipes 543*a* into the discharge casing 542 of each of the discharge nozzle parts 540, and then may be discharged through the discharge hole 541 to a person.

Furthermore, the discharged air may be introduced back to the introduction flow path 521*a* of the footrest 520 and then may flow sequentially through the air management module 200, the fan assembly 300, and the duct unit 400. In this manner, air circulation may be repeatedly performed.

Accordingly, dust, moisture, contaminants introduced to the entrance space by being attached to a person's clothes, shoes, or body may be removed in the entrance space, and the person may enter an indoor area with the contaminants removed.

Meanwhile, when the hygiene management of a person described above is performed, the detector 550 may detect a person's height or face position, and information on the detected height or face position may be transmitted to the controller.

In addition, the controller may determine the associated person's position on the basis of the person's height or face position information. That is, the controller may determine where the person is located on the top surface of the footrest 520 with the information which the controller has acquired.

Furthermore, after completing determination on the person's height or face position and the person's position, the controller may control the opposite side rotations of each of the pillar frames 530 on the basis of the determined information. That is, the controller may control the operation of each of the rotary motors 571 to adjust the opposite side rotation angles of each of the pillar frames 530 such that the discharge hole 541 of the discharge nozzle part 540 is directed to a person.

Accordingly, a sufficient amount of air may be discharged toward a person regardless of a position at which the person is standing for hygiene management. Of course, even when at least two persons enter at the same time, a sufficient amount of air may be discharged to the two persons.

In addition, the controller may control the operation of each of the flow path opening/closing valves 544 such that the discharge hole 541 of the discharge nozzle part 540 which discharges air to a position above a person's height is closed. That is, air may not be discharged to the discharge nozzle part 540 located at the same or higher position than a person's height. Accordingly, it is possible to prevent unnecessary air discharge and perform intensive air discharge to a person.

In addition, the controller may control the operation of each of the angle adjustment motors 561 such that the discharge hole 541 of the discharge nozzle part 540 is not directed to a person's face. That is, air may not be discharged to a person's face to prevent the person from feeling unpleasant.

Meanwhile, the controller may control the operation of the discharge nozzle part 540 according to the movement of a person.

That is, the controller may continuously check a person's position and height or face position through the detector 550, and may continuously control each of the rotary motors 571 and each of the angle adjustment motors 561 on the basis of the checked person's position and height or face position.

Accordingly, even if a person passes through the hygiene management device without stopping, the hygiene management device may discharge a sufficient amount of air to the person, and may remove as many contaminants as possible from the person.

Finally, in the hygiene management device for an entrance hall of the present disclosure, air may be discharged to a person at a plurality of positions around the person, so contaminants such as dust attached to the clothing of a person may be efficiently removed.

Furthermore, in the hygiene management device for an entrance hall of the present disclosure, air may be discharged in consideration of a person's height, and thus may not be discharged to a position above the person's height, so unnecessary air discharge may be prevented. That is, it is possible to perform intensive air discharge to a person, so the performance of removing foreign matter attached to the clothing of the person may be improved.

Furthermore, in the hygiene management device for an entrance hall of the present disclosure, air may be discharged in consideration of a person's face position, so the person may be prevented from having difficulty in breathing or feeling unpleasant due to air discharge.

Furthermore, in the hygiene management device for an entrance hall of the present disclosure, each of the pillar frames 530 may be installed to be rotatable toward opposite sides, so air may be discharged to a person regardless of a position at which the person is standing.

Furthermore, in the hygiene management device for an entrance hall of the present disclosure, each of the pillar frames 530 may be installed to be rotatable toward opposite sides, so even if a person is moving without stopping, air may be discharged to the person.

Meanwhile, in the hygiene management device for an entrance hall of the present disclosure, air may be discharged even through the top plate.

For example, a separate air duct connecting the inner space of the second duct with the top plate may be provided, so air may be discharged even to the top plate.

A blower fan may be provided in the air duct, so when required, air may be discharged to the top plate, or the pressure of air discharged from the top plate may be controlled.

When the air duct and the blower fan are added, in consideration of a person's height, the amount or pressure of air discharged from the top plate may be controlled. That is, air may be discharged at high pressure to a short person such that a sufficient amount of air is discharged to the person. Air may be discharged at low pressure to a tall person such that giving discomfort to the person due to excessive air discharge can be prevented.

Accordingly, the hygiene management device for an entrance hall of the present disclosure may be variously embodied.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hygiene management device, comprising:

a fan assembly configured to generate an air flow;

a duct connected to the fan assembly and configured to guide a flow of the air; and an air discharger connected to the duct and configured to discharge the air guided from the duct to a person, the air discharger including:

a top plate located at an upper side of an entrance space;

a footrest located at a bottom side of the entrance space and facing the top plate; and a plurality of pillar frames connecting the top plate with the footrest, each pillar frame having a discharge nozzle part which discharges air to the person, wherein each pillar frame is positioned between the top plate and the footrest and is rotatable, and wherein each pillar frame is disposed on an edge portion of the footrest.

2. The hygiene management device of claim 1, wherein the plurality of pillar frames are mounted to at least two corners of the top plate and to corresponding corners of the footrest.

3. The hygiene management device of claim 1, further comprising a plurality of pillar rotating parts provided on an upper surface of the top plate to enable rotation of the plurality of pillar frames.

4. The hygiene management device of claim 3, wherein each pillar rotating part comprises a rotary motor configured to rotate to adjust a rotation angle of each pillar frame.

5. The hygiene management device of claim 1, further comprising:

an upper roller provided on an upper surface of each pillar frame;

an upper guide groove formed in the top plate and receiving the upper roller to guide a movement of the upper roller;

a lower roller provided on a lower surface of each pillar frame; and a lower guide groove formed in the footrest and receiving the lower roller to guide a movement of the lower roller.

6. The hygiene management device of claim 1, wherein the discharge nozzle part includes a plurality of discharge nozzle parts, the plurality of discharge nozzle parts being located on each of the plurality of pillar frames to be spaced vertically apart from each other.

7. The hygiene management device of claim 1, wherein each of the discharge nozzle part is configured to selectively receive air from the duct.

8. The hygiene management device of claim 1, wherein each of the plurality of pillar frames includes a detector configured to detect a person's height or face position.

9. The hygiene management device of claim 8, wherein the detector is located at the discharge nozzle part.

10. The hygiene management device of claim 1, wherein the discharge nozzle part is configured to have an adjustable inclination angle in an upward/downward direction to adjust an upward/downward discharge direction of air.

11. The hygiene management device of claim 10, wherein the discharge nozzle part includes a rotation shaft mounted rotatably to the discharge nozzle part such that the discharge nozzle part is configured to incline upward/downward relative to each of the plurality of pillar frames, and wherein each of the plurality of pillar frames includes a nozzle angle adjustment part that is configured to cause a rotation of the rotation shaft.

12. The hygiene management device of claim 11, wherein the nozzle angle adjustment part includes an angle adjustment motor connected to the rotation shaft directly or by a power transmission member such that power is transmitted between the angle adjustment motor and the rotation shaft.

13. The hygiene management device of claim 1, wherein the duct includes:

a first duct positioned along a side of the footrest; and a second duct extending from the first duct and located above the top plate, and wherein the second duct and each of the plurality of pillar frames are connected to each other by a guide tube, the guide tube being configured to transmit air between the second duct and each of the plurality of pillar frames.

14. The hygiene management device of claim 13, wherein the discharge nozzle part includes:

a discharge casing having a discharge hole formed therein such that air is discharged through the discharge hole; and an air transfer duct positioned along an inside of each of the plurality of pillar frames, the air transfer duct being configured to receive air from the guide tube to transfer the air to the discharge casing.

15. The hygiene management device of claim 14, wherein the guide tube includes a flow path opening/closing valve configured to open/close an associated flow path with the air transfer duct.

16. The hygiene management device of claim 1, further comprising an air management module connected to an air inlet of the fan assembly and configured to remove foreign matter or contaminants from air before the air enters the fan assembly, wherein the footrest includes an introduction flow path that is configured to guide air flow to the air management module.

17. A hygiene management device, comprising:

an air discharger including:

a top plate located at an upper side of an entrance space;

a footrest located at a bottom side of the entrance space opposite to the upper side; and a plurality of pillar frames connecting the top plate with the footrest and extending between the top plate and the footrest, each of the plurality of pillar frames having at least one adjustable discharge nozzle part configured to discharge air at varying angles to the entrance space, wherein each pillar frame is positioned between the top plate and the footrest and is rotatable, and wherein each pillar frame is disposed on an edge portion of the footrest.

18. The hygiene management device of claim 17, further including:

a plurality of pillar rotating parts provided on an upper surface of the top plate so as to enable rotation of the plurality of pillar frames; and a drive member, wherein each of the plurality of pillar rotating parts includes a plurality of rollers and a plurality of guide grooves receiving the plurality of rollers, the plurality of rollers being configured to move within the plurality of guide grooves, and wherein the drive member is configured to apply a driving force to the plurality of rollers to cause the plurality of rollers to move within the plurality of guide grooves to move the plurality of pillar frames.

19. The hygiene management device of claim 17, further comprising a detector configured to determine a location of a person disposed in the hygiene management device, wherein each of the plurality of pillar frames are configured to rotate such that air is blown by each pillar frame to the location of the person determined by the detector.

20. The hygiene management device of claim 19, wherein the at least one adjustable discharge nozzle part is configured to only discharge air to a maximum height of the person.

* * * * *